US008516720B2

(12) United States Patent
Gerber

(10) Patent No.: US 8,516,720 B2
(45) **Date of Patent: *Aug. 27, 2013**

(54) INTERCHANGEABLE POD SYSTEM

(75) Inventor: Clifford B. Gerber, West Linn, OR (US)

(73) Assignee: NIKE, Inc., Beaverton, OR (US)

( * ) Notice: Subject to any disclaimer, the term of this patent is extended or adjusted under 35 U.S.C. 154(b) by 300 days.

This patent is subject to a terminal disclaimer.

(21) Appl. No.: 13/017,224

(22) Filed: Jan. 31, 2011

(65) Prior Publication Data

US 2011/0119962 A1 May 26, 2011

Related U.S. Application Data

(63) Continuation of application No. 12/960,749, filed on Dec. 6, 2010, now Pat. No. 8,250,781, which is a continuation of application No. 11/676,159, filed on Feb. 16, 2007, now Pat. No. 7,866,064.

(51) Int. Cl.
*A43B 3/24* (2006.01)
*A43C 15/00* (2006.01)

(52) U.S. Cl.
USPC ..... 36/15; 36/100; 36/67 D

(58) Field of Classification Search
USPC ..... 36/15, 59 R, 62, 65, 66, 134, 100
See application file for complete search history.

(56) References Cited

U.S. PATENT DOCUMENTS

| | | | |
|---|---|---|---|
| 217,969 | A | 7/1879 | Wilson |
| 409,938 | A | 8/1889 | Dickson |
| 1,087,212 | A | 2/1914 | Caldwell |
| 1,229,278 | A | 6/1917 | Johnson |
| 2,034,050 | A | 3/1936 | Levy |
| 2,061,963 | A | 11/1936 | Gabriele |
| 2,095,095 | A | 10/1937 | Howard |
| 2,116,956 | A | 5/1938 | Vorwerk |
| 2,118,107 | A | 5/1938 | Riddell |
| 2,276,887 | A | 3/1942 | Smith |
| 2,303,682 | A | 12/1942 | Bullis |
| 2,629,943 | A | 3/1953 | Camody |
| 2,640,283 | A | 6/1953 | McCord |
| 2,745,197 | A | 5/1956 | Holt |
| 3,328,901 | A | 7/1967 | Strickland |
| 3,442,033 | A | 5/1969 | Hilburn, Jr. |
| 3,526,976 | A | 9/1970 | Jacobs |
| 3,982,336 | A | 9/1976 | Herro |
| 4,507,879 | A | 4/1985 | Dassler |
| 4,559,724 | A | 12/1985 | Norton |
| 4,590,693 | A | 5/1986 | Kawashima et al. |

(Continued)

FOREIGN PATENT DOCUMENTS

| | | |
|---|---|---|
| DE | 4417563 | 11/1995 |
| EP | 0533570 | 3/1993 |
| FR | 2790370 | 9/2000 |
| GB | 1263960 | 2/1972 |

*Primary Examiner* — Marie Patterson

(74) *Attorney, Agent, or Firm* — Plumsea Law Group, LLC

(57) ABSTRACT

An article of footwear with an interchangeable pod system is disclosed. The interchangeable pod system includes an outsole, a pod set, and a cleat set. The pods are attached to the outsole by means of the members of the cleat set. Variations in the types of pods and cleats used allow a wearer to reconfigure the article of footwear in order to maximize performance on a given surface in a given set of surface conditions as well as other parameters.

24 Claims, 22 Drawing Sheets

(56) References Cited

U.S. PATENT DOCUMENTS

| | | | | |
|---|---|---|---|---|
| 4,782,604 | A | 11/1988 | Wen-Shown | |
| 4,875,300 | A | 10/1989 | Kazz | |
| 5,426,873 | A | 6/1995 | Savoie | |
| 5,459,946 | A | 10/1995 | Rayow | |
| 5,473,827 | A | 12/1995 | Barre et al. | |
| 5,524,367 | A | 6/1996 | Ferreira et al. | |
| 5,657,558 | A | 8/1997 | Pohu | |
| 5,761,833 | A | 6/1998 | McMullin | |
| 5,887,363 | A | 3/1999 | Rhodes | |
| 5,946,828 | A | 9/1999 | Jordan et al. | |
| 5,979,083 | A | 11/1999 | Robinson et al. | |
| 6,161,315 | A | 12/2000 | Dalton | |
| 6,256,907 | B1 | 7/2001 | Jordan et al. | |
| 6,708,426 | B2 * | 3/2004 | Erickson et al. | 36/127 |
| 6,722,061 | B2 | 4/2004 | Auger et al. | |
| 6,748,677 | B2 | 6/2004 | Briant et al. | |
| 6,754,984 | B2 | 6/2004 | Schaudt et al. | |
| 6,813,847 | B2 | 11/2004 | Workman | |
| 6,941,684 | B2 | 9/2005 | Auger et al. | |
| 6,954,998 | B1 | 10/2005 | Lussier | |
| 7,121,020 | B1 * | 10/2006 | Bathum | 36/102 |
| 7,134,226 | B2 | 11/2006 | Robinson, Jr. et al. | |
| 7,461,470 | B2 | 12/2008 | Dardinski et al. | |
| 7,654,013 | B2 | 2/2010 | Savoie et al. | |
| 7,866,064 | B2 * | 1/2011 | Gerber | 36/62 |
| 8,250,781 | B2 * | 8/2012 | Gerber | 36/15 |
| 2003/0230007 | A1 | 12/2003 | Walton | |
| 2005/0198868 | A1 | 9/2005 | Scholz | |
| 2007/0107268 | A1 | 5/2007 | Seeman et al. | |
| 2007/0163148 | A1 | 7/2007 | Laporte | |
| 2009/0013561 | A1 | 1/2009 | Robinson et al. | |

* cited by examiner

| | 602 | 610 | 620 | 802 |
|---|---|---|---|---|
| | FIRST CLEAT ELEMENT SET | SECOND CLEAT ELEMENT SET | THIRD CLEAT ELEMENT SET | NTH CLEAT ELEMENT SET |
| FIRST POD ELEMENT SET (630) | FIRST CLEAT ELEMENT SET + FIRST POD ELEMENT SET (702) | SECOND CLEAT ELEMENT SET + FIRST POD ELEMENT SET | THIRD CLEAT ELEMENT SET + FIRST POD ELEMENT SET | NTH CLEAT ELEMENT SET + FIRST POD ELEMENT SET |
| SECOND POD ELEMENT SET (670) | FIRST CLEAT ELEMENT SET + SECOND POD ELEMENT SET (704) | SECOND CLEAT ELEMENT SET + SECOND POD ELEMENT SET | THIRD CLEAT ELEMENT SET + SECOND POD ELEMENT SET (808) | NTH CLEAT ELEMENT SET + SECOND POD ELEMENT SET |
| THIRD POD ELEMENT SET (684) | FIRST CLEAT ELEMENT SET + THIRD POD ELEMENT SET | SECOND CLEAT ELEMENT SET + THIRD POD ELEMENT SET | THIRD CLEAT ELEMENT SET + THIRD POD ELEMENT SET (701) | NTH CLEAT ELEMENT SET + THIRD POD ELEMENT SET |
| NTH POD ELEMENT SET (804) | FIRST CLEAT ELEMENT SET + NTH POD ELEMENT SET | SECOND CLEAT ELEMENT SET + NTH POD ELEMENT SET | THIRD CLEAT ELEMENT SET + NTH POD ELEMENT SET | NTH CLEAT ELEMENT SET + NTH POD ELEMENT SET (806) |

FIG. 10

INTERCHANGEABLE POD SYSTEM

This application is a continuation of U.S. Pat. No. 8,250,781, issued Aug. 28, 2012 (U.S. Patent Publication Number US2011/0072688, published Mar. 31, 2011, and U.S. patent application Ser. No. 12/960,749, filed Dec. 6, 2010), which is a continuation of U.S. Pat. No. 7,866,064, issued Jan. 11, 2011, both of which are herein incorporated by reference in their entirety.

BACKGROUND OF THE INVENTION

1. Field of the Invention

The present invention relates generally to footwear, and in particular the present invention relates to an interchangeable traction system.

2. Description of Related Art

Some forms of athletic footwear may include some type of cleat, such as a stud or a spike, which provide additional traction. Football players often use footwear with cleats to gain additional traction in natural grass or synthetic grass. Removable cleats have been previously proposed, allowing the cleats to be replaced after having been worn down or broken, without the need to replace the entire article of footwear. In some cases, different types of cleats may be used for various conditions, including wet or dry grass.

Herro (U.S. Pat. No. 3,982,336) discloses an athletic shoe that has a portion with a sole having a number of projections extending from the sole. The design of Herro includes a detachable sole with a number of cleats or the like extending therefrom and has grooves designed to mate with the projections on the sole of the shoe.

Schaudt (U.S. Pat. No. 6,754,984) discloses a soccer shoe comprising a sole which is made of plastic and has on its underside at least one carrier surface that is configured raised. Each surface includes at least two threaded inserts being embedded that serve for receiving traction elements capable of being screwed in. Also disclosed is a sports shoe in which the traction elements consist of a set of clamping jaws that extend across the entire width of the shoe and comprise a mounting surface adapted to the geometric shape of the at least one carrier surface as well as through-holes for receiving fastening screws, the through-holes being registered with the threaded inserts.

Dassler (GB patent number 1,263,960) discloses an article of sports footwear having a plurality of retaining inserts mounted therein. The design of Dassler includes a structural element releasably securing into each said insert by means of a screw bolt engaging into a threaded sleeve in the insert and a plurality of elongate spikes on and projecting below each said structural element.

Wilson (U.S. Pat. No. 217,969) discloses an adjustable sole or heel plate, provided with brads or spikes and a flange, removable secured to a boot or shoe by means of set-screws, which engage with plates in the bottom of the sole or heel, substantially as and for the purposes set forth.

None of these patents disclose an article of footwear containing both cleats, including studs and/or spikes, and tread elements that are distinct from the cleats but which further serve to provide an article of footwear with traction.

Furthermore, like interchangeable cleats, which provide differing kinds of traction based on the type and/or conditions of the surface, there is a need for tread element configurations that may also be interchanged, to provide more subtle variations in traction needs. In this way the user of such footwear need only purchase one article of footwear, but can purchase, independently, interchangeable tread configurations and cleats to be fastened to the outsole of the footwear.

SUMMARY OF THE INVENTION

An article of footwear including an interchangeable pod element set is disclosed. The present invention provides an article of footwear, comprising: an upper and an outsole; a pod set, including a first pod and a second pod; the outsole including a mounting region configured to receive the pod set; the first pod including at least one tread element and the second pod including at least one tread element; and where the first pod is fastened to the outsole by at least two cleats and wherein the second pod is fastened to the outsole by at least two cleats.

In another aspect, the first pod includes multiple tread elements, the tread elements comprising a tread configuration.

In another aspect, the second pod includes multiple tread elements, the tread elements comprising a tread configuration.

In another aspect, each cleat includes a fastening portion and a cleat head.

In another aspect, each mounting region includes at least two holes configured to receive the fastener portions of the cleats.

In another aspect, the first pod includes at least two through-holes configured to receive the fastener portions of the cleats.

In another aspect, the second pod includes at least two through-holes configured to receive the fastener portions of the cleats.

In another aspect, the holes correspond to the through-holes.

In another aspect, the mounting region is a recessed region.

In another aspect, the invention provides an article of footwear, comprising: an upper and an outsole; a pod set; the pod set comprising at least two pods, each pod being substantially similar in size and shape with other pods of the pod set; the outsole including a mounting region configured for receiving a pod; each pod including at least one tread element; and where each pod is fastened to the outsole by a cleat.

In another aspect, the pods are non-circular in shape.

In another aspect, the pods are V-shaped.

In another aspect, the pods include more than one tread element.

In another aspect, each cleat includes a fastener portion and a cleat head.

In another aspect, each mounting region includes one hole configured to receive the fastener portions of the cleats.

In another aspect, each pod includes one through-hole configured to receive the fastener portions of the cleats.

In another aspect, the holes correspond to the through-holes.

In another aspect, the mounting region is a recessed region.

In another aspect, the invention provides an article of footwear, comprising: an upper and an outsole; a pod set; the pod set comprising at least two pods, each pod being substantially similar in size and shape with other pods of the pod set; the outsole including at least one mounting region configured for receiving a pod; each pod in the pod set including at least one mechanical connector; and where each pod is fastened to the outsole by a cleat and by at least one mechanical connector.

In another aspect, each cleat includes a fastener portion and a cleat head.

In another aspect, the mounting regions include a hole configured to receive the fastener portion of a cleat and a slot configured to receive a mechanical connector.

In another aspect, each pod includes a through-hole through which the fastener portion of a cleat may be inserted.

In another aspect, the holes correspond to the through-holes.

In another aspect, the pods include two mechanical connectors and the mounting regions include two slots configured for receiving the two mechanical connectors.

In another aspect, the invention provides an article of footwear, comprising: an upper and an outsole; a pod set, including a first pod and a second pod; the first pod being fixed to the outsole by a cleat and the second pod being fixed to the outsole by a cleat; and where the first pod includes a first region, a second region, and a third region, and wherein the second region is more flexible than the first region and the third region.

In another aspect, the first pod includes a first indented region and a second indented region.

In another aspect, the first indented region and the second indented region are connected by a grooved region that is disposed along the second region of the first pod.

In another aspect, the invention provides an article of footwear, comprising: an upper and an outsole; the outsole including a first portion and a second portion; the first portion including a first base portion and a first curved periphery, the first curved periphery being disposed at an angle to the first base portion; the second portion including a second base portions and a second curved periphery, the second curved periphery being disposed at an angle to the second base portion; a first pod and a second pod; each pod being fastened to the outsole by at least one cleat; and where the first pod is configured to cover the first base portion of the first portion and a substantial majority of the curved periphery, and wherein the second pod is configured to cover the second base portion of the second portion and a substantial majority of the second curved periphery.

In another aspect, the first pod includes at least one ridge, which is a continuous deformation of the first pod.

In another aspect, the second pod includes at least one ridge, which is a continuous deformation of the second pod.

In another aspect, the first pod includes a first indented region and a second indented region.

In another aspect, each cleat includes a fastener portion and a cleat head.

In another aspect, the outsole includes holes configured for receiving the fastener portions of the cleats.

In another aspect, the holes are disposed along raised mounds.

In another aspect, each pod includes through-holes configured for receiving the fastener portions of the cleats.

In another aspect, the holes correspond to the through-holes.

In another aspect, the invention provides an article of footwear, comprising: an upper and an outsole; a pod set, including a first and second pod; the first pod including an outer periphery; the first pod including a set of mechanical connectors disposed along the outer periphery; each pod being fastened to the outsole by at least one cleat; and where the outsole includes a set of slots configured for receiving the mechanical connectors.

In another aspect, the mechanical connectors are located along a rear side of the outer periphery.

In another aspect, the mechanical connectors are disposed along a rear indented portion of the outer periphery.

In another aspect, the invention provides a method for assembling an article of footwear comprising the step of: selecting a pod set from a group of candidate pod sets; associating a first pod of the selected pod set with the outsole of the article of footwear; selecting a cleat set from a group candidate cleat sets; and thereby attaching the selected pod set to the outsole using the selected cleat set.

In another aspect, the pod set includes two pods.

In another aspect, pod set includes one pod.

In another aspect, the number of cleats comprising the cleat set is greater than the number of pods comprising the pod set.

In another aspect, the group of candidate pod sets includes a pod set configured for wet surfaces conditions.

In another aspect, the group of candidate cleat sets includes a cleat set configured for wet surface conditions.

In another aspect, the group of candidate pod sets includes a pod set configured for dry surface conditions.

In another aspect, the group of candidate cleat sets includes a cleat set configured for dry surface conditions.

In another aspect, the invention provides an article of footwear, comprising: an upper and an outsole; a pod; the outsole including a mounting region configured to receive the pod; the pod including at least one tread element; and wherein the pod is fastened to the outsole by at least two cleats.

In another aspect, the pod includes multiple tread elements, the tread elements comprising a tread configuration.

In another aspect, each cleat includes a fastening portion and a cleat head.

In another aspect, the mounting region includes at least two holes configured to receive the fastener portions of the cleats.

In another aspect, the pod includes at least two through-holes configured to receive the fastener portions of the cleats.

In another aspect, the holes correspond to the through-holes.

In another aspect, the tread elements have a length shorter than the length of the cleats.

In another aspect, the cleats penetrate substantially further into a surface than the tread elements.

In another aspect, the invention provides an article of footwear, comprising: an upper and an outsole; the outsole including a first portion; the first portion including a first base portion and a first curved periphery, the first curved periphery being disposed at an angle to the first base portion; a first pod being fastened to the outsole by at least one cleat; and wherein the first pod is configured to cover the first base portion of the first portion and a substantial majority of the curved periphery.

In another aspect, the first pod includes at least one ridge, which is a continuous deformation of the first pod.

In another aspect, the first pod includes a first indented region and a second indented region.

In another aspect, each cleat includes a fastener portion and a cleat head.

In another aspect, the outsole includes holes configured for receiving the fastener portions of the cleats.

In another aspect, the holes are disposed along raised mounds.

In another aspect, the pod includes through-holes configured for receiving the fastener portions of the cleats.

In another aspect, the holes correspond to the through-holes.

In another aspect, the invention provides an article of footwear, comprising: an upper and an outsole; a group of pod sets; the pod sets comprising at least two pods, each pod being substantially similar in size and shape with other pods of the pod set; each pod being fastened to the outsole by a cleat and by at least one mechanical connector; and wherein each pod set of the group of pod sets is manufactured to a different size, each different size being associated with a range of footwear sizes.

In another aspect, each cleat includes a fastener portion and a cleat head.

In another aspect, the outsole includes a hole configured to receive the fastener portion of a cleat and a slot configured to receive a mechanical connector.

In another aspect, each pod includes a through-hole through which the fastener portion of a cleat may be inserted.

In another aspect, the holes correspond to the through-holes.

In another aspect, the pods include two mechanical connectors and the outsole includes two slots configured for receiving the two mechanical connectors.

In another aspect, the group of pod sets includes three pods sets, each pod set having a different size.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

FIG. 10 is a schematic view of a preferred embodiment of possible configurations using an interchangeable pod system;

DETAILED DESCRIPTION OF THE PREFERRED EMBODIMENTS

Figure 1:
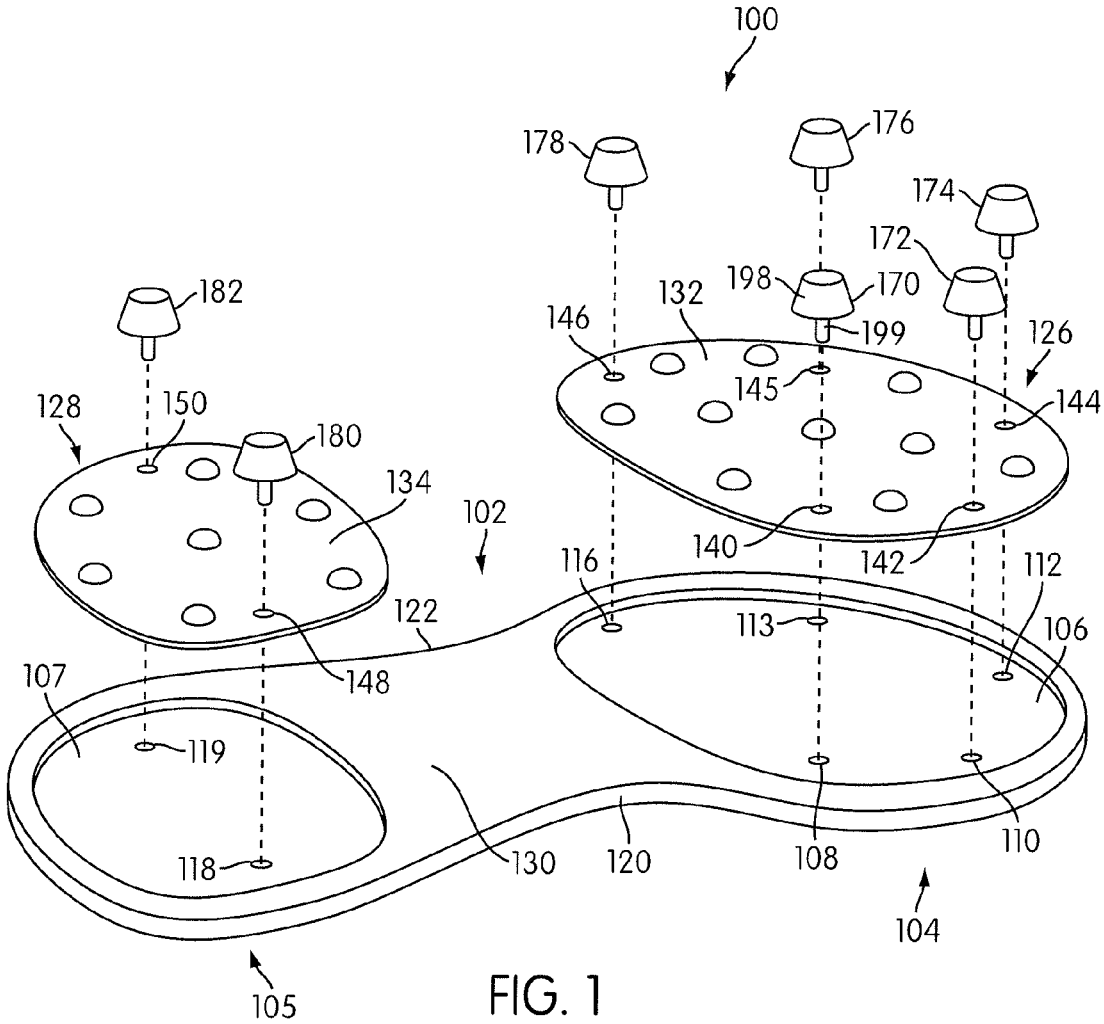
FIG. 1 is an exploded isometric view of a preferred embodiment of an interchangeable pod system.

FIG. 1 is an isometric view of a preferred embodiment of interchangeable pod system 100. Interchangeable pod system 100 preferably includes outsole 102. Outsole 102 is preferably integrated into an article of footwear, and need not be detachable from an article of footwear. In FIG. 1, outsole 102 is shown in isolation in order to emphasize the preferred components of interchangeable pod system 100. Outsole 102 may assume any shape, including various thicknesses and styles.

Preferably, outsole 102 includes a forefoot portion 104 and a heel portion 105. Forefoot portion 104 and heel portion 105 are preferably configured to receive the forefoot and the heel of the foot respectively. Preferably, outsole 102 includes a first mounting region 106 disposed along forefoot portion 104 and a second mounting region 107 disposed along heel portion 105. In some embodiments, first mounting region 106 may be a recessed region. Likewise, second mounting region 107 may be a recessed region. First mounting region 106 and second mounting region 107 may be any size. Although two recessed regions are included in this embodiment, in general there can be any number of recessed regions included in outsole 102.

These mounting regions are preferably include provisions to receive pods. The term pod, as used throughout this specification and the claims, refers to a device configured to cover a portion of an outsole. In particular, pods may include tread configurations. These pods may cover regions of the forefoot of the outsole of the article of footwear, as well as regions in the rear or heel of the outsole. Using a cleat fastening system, the cleats may be inserted through through-holes in the pods and fastened to the outsole of the article of footwear, simultaneously fastening the pods to the outsole as well.

In particular, first mounting region 106 preferably includes first hole 108, second hole 110, third hole 112, fourth hole 113, and fifth hole 116. First hole 108 and second hole 110 are preferably disposed along medial side 120 of outsole 102. Fifth hole 116 and fourth hole 113 are preferably disposed along lateral side 122 of outsole 102. Third hole 112 is preferably disposed between second hole 110 and fourth hole 113. Likewise, second mounting region 107 preferably includes a sixth hole 118, disposed along medial side 120 of outsole 102. Second mounting region 107 also preferably includes seventh hole 119 disposed along lateral side 122 of outsole 102. Although this embodiment includes seven holes in outsole 102, other embodiments may include any number of holes.

In order to maximize a user's performance on various surfaces and/or surface conditions, an article of footwear may include provisions for maintaining a desired level of traction between the article of footwear and the surface. One such provision is a tread element, which is intended to provide additional traction between an article of footwear and a given surface by way of surface friction. Tread elements may also penetrate the surface. A group of tread elements is referred to as a tread configuration in this specification and in the claims.

In addition to outsole 102, interchangeable pod system 100 preferably includes pods. These pods may include multiple tread elements, that together form tread configurations. These tread configurations, when used simultaneously with cleats, allow a user to configure or custom tailor the type of traction applied.

In a preferred embodiment, interchangeable pod system 100 includes first pod 126 and second pod 128. In some embodiments, first pod 126 is associated with forefoot portion 104, and second pod 128 is associated with heel portion 105. In some embodiments, first pod 126 and second pod 128 may be constructed of a rubber material or a synthetic plastic. However, in other embodiments, first pod 126 and second pod 128 may be constructed from other materials. In some embodiments, first pod 126 and second pod 128 may be constructed of the same material.

In addition to varying the material composition of the pods, the number of pods used with an article of footwear may also be varied in other embodiments. While two pods are shown in this embodiment, other embodiments may include a different number of pods. Some embodiments may include one pod, while others may include more than two pods.

In general, pods may be attached to an outsole of an article of footwear via the mounting regions. In a preferred embodiment, first mounting region 106 is preferably configured to receive first pod 126. In some embodiments, outsole outer face 130 and first pod outer face 132 may be flush once first pod 126 has been inserted into first mounting region 106. In some embodiments, first pod outer face 132 may be raised with respect to outsole outer face 130.

In a preferred embodiment, second mounting region 107 is preferably configured to receive second pod 128. In some embodiments, outsole outer face 130 and second pod outer face 134 may be flush once second pod 128 has been inserted into second mounting region 107. In some embodiments, second pod outer face 134 may be raised with respect to outsole outer face 130.

Preferably, each pod includes provisions for fastening the pod to be fastened to outsole 102. Because embodiments of the present invention contemplate the use of cleats that are attached to outsoles with a threaded fastener, a preferred embodiment of the interchangeable pod system includes a mechanism for attaching the pods to the outsole via threaded cleats. In this way no additional screws or other fastening mechanisms are necessary to attach a pod to the outsole of an article of footwear.

First pod 126 preferably includes first through-hole 140, second through-hole 142, third through-hole 144, fourth through-hole 145, and fifth through-hole 146. Preferably, first through-hole 140, second through-hole 142, third through-hole 144, fourth through-hole 145, and fifth through-hole 146 are disposed in first pod 126 so as to be in alignment with first hole 108, second hole 110, third hole 112, fourth hole 113, and fifth hole 116 respectively. In particular, first through-hole 140, second through-hole 142, third through-hole 144, fourth through-hole 145, and fifth through-hole 146 are constructed in such a way that a small fastener could be inserted through each through-hole.

Second pod 128 preferably includes sixth through-hole 148 and seventh through-hole 150. Preferably, sixth through-hole 148 and seventh through-hole 150 are disposed in second pod 128 so as to be in alignment with sixth hole 118 and a seventh hole 119, respectively. In particular, sixth through-hole 148 and seventh through-hole 150 are preferably constructed in such a way that a small fastener could be inserted through second pod 128. In general, the number of through-holes included in each pod may be varied, though it is preferable in this embodiment, that each pod contains at least two through-holes.

Each pod set preferably includes a distinct type of tread configuration. Different tread configurations may be used to provide varying degrees of traction, which is a desirable property since different surfaces often require different kinds of traction in order for the user to achieve maximum performance.

Figure 2:
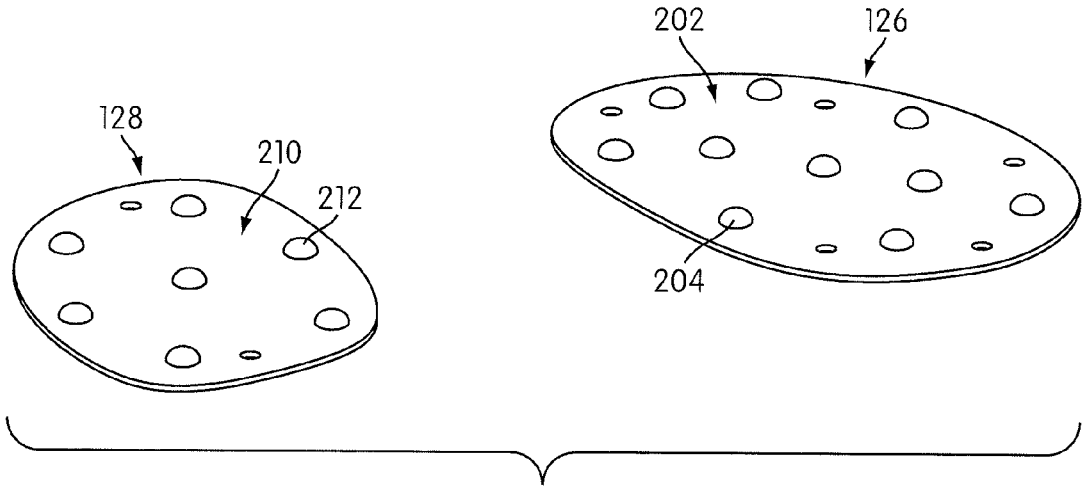
FIG. 2 is an isometric view of a preferred embodiment of a first pod and a second pod.

FIG. 2 is an isolated isometric view of a preferred embodiment of first pod 126 and second pod 128. As seen in FIG. 2, first pod 126 preferably includes first tread element configuration 202. First tread element configuration includes first tread element 204 as well as other tread elements. In this embodiment first tread element 204 is hemispheric in shape, but in other embodiments it may be any size and shape. The other tread elements comprising tread configuration 202 may also be hemispheric in shape. In a similar manner, second pod 128 also includes second tread element configuration 210. Second tread element configuration 210 includes second tread element 212 as well as other tread elements. Tread element 212 and the other tread elements may also be manufactured in various sizes and shapes. In addition to the shape and size, there may be some variability in the number of tread elements that comprise first tread element configuration 202 and second tread element configuration 210.

In some embodiments, the spacing between tread elements in first tread element configuration 202 and second tread element configuration 210 may be varied. First tread configuration 202 and second tread configuration 210 may be constructed of the same material as first pod 126 and second pod 128 respectively. In some embodiments, first tread configuration 202 and second tread configuration 210 may be constructed of a different material from first pod 126 and second pod 128 respectively. Additionally, first tread configuration 202 and second tread configuration 210 need not be constructed of the same material.

An additional provision for maintaining a desired level of traction is a cleat. Unlike a tread element, which creates traction through some penetration and surface friction, a cleat only creates traction through substantially deeper penetration than a tread element. Generally, the cleats are configured to penetrate further into a surface than tread elements. Cleats are also generally longer than tread elements.

Furthermore, different surfaces and/or surface conditions require different types of tread elements and cleats in order to assist in maximizing the user's performance. An article of footwear with both interchangeable tread element configurations and interchangeable cleats is disclosed. Together, tread element configurations and cleats preferably provide the article of footwear with the desired amount of traction. The term traction set, as used throughout this specification and the claims, refers to a set of cleats and tread elements used simultaneously with an article of footwear.

Cleats are used in articles of footwear to provide traction on surfaces that may be deformed during use. The longer length and pointed shape of a cleat, as opposed to a tread element, allows the cleat to insert into the surface, providing additional traction beyond the typical friction achieved by using tread elements alone. For this reason, it is preferable that an interchangeable pod system include cleats as well as tread elements.

As seen in FIG. 1, interchangeable pod system 100 preferably includes first cleat 170, second cleat 172, third cleat 174, fourth cleat 176, fifth cleat 178, sixth cleat 180, and seventh cleat 182. First cleat 170 also preferably includes cleat head 198 and fastener portion 199. In general, the number of cleats included in interchangeable pod system 100 can be different than seven. Some embodiments may include less than seven cleats, while other embodiments may include more than seven cleats. In this embodiment, it is preferable that the number of total cleats is at least twice the number of pods.

Figure 3:
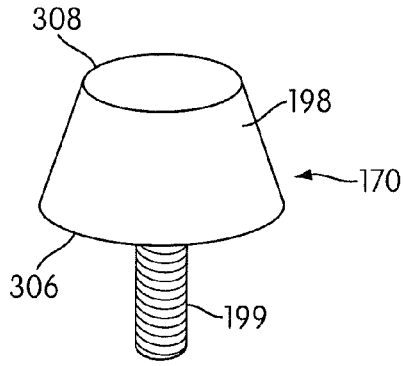
FIG. 3 is an isometric view of a preferred embodiment of a cleat.

FIG. 3 is an isolated view of a preferred embodiment of first cleat 170. Preferably, first cleat 170 includes cleat head 198, as well as fastener portion 199. Cleat head 198 may be composed of a variety of materials, including, but not limited to, rubber, hard plastic, or metal. Preferably, cleat head 198 is widest at cleat base 306 and narrowest at cleat tip 308. This allows first cleat 170 to efficiently penetrate into surfaces during use. Fastener portion 199 is preferably made of a durable material that will not break while cleat 170 is engaged with a surface. In particular, fastener portion 199 may be threaded in some embodiments, like a screw, or include some portion that is threaded. This feature allows for first cleat 170 to be fastened to outsole 102. In some embodiments, fastener portion 199 may include another mechanism by which cleat 170 may be fastened to outsole 102.

In a preferred embodiment, all aspects of first cleat 170 described here apply to second cleat 172, third cleat 174, fourth cleat 176, fifth cleat 178, sixth cleat 180, and seventh cleat 182 as well, which are seen in FIG. 1. That is, the cleats are substantially similar in all respects. In other embodiments, the various cleats may differ slightly in size, shape, or material composition.

An important advantage of the present disclosure is the ease with which the pods may be assembled to the outsole of the article of footwear through the use of removable cleats. Referring to FIG. 1, first cleat 170 is preferably configured to insert through first through-hole 140 and engage first hole 108. In particular, fastener portion 199 extends through first through-hole 140 and engages first hole 108. In some embodiments, first hole 108 may include corresponding threading that engages with the threading disposed along fastener portion 199, so that first cleat 170 may be screwed into outsole 102. In some embodiments, there may be other mechanisms by which fastener portion 199 engages with first hole 108 to attach first cleat 170 to outsole 102. Preferably, first through-hole 140 is just large enough so that fastener portion 199 can be inserted, but small enough so that cleat head 198 can not be inserted through first through-hole 140. As first cleat 170 is fastened to outsole 102, cleat head 198 imposes a force on first pod outer face 132 in a region around first through-hole 140. The compressive force applied to first pod outer face 132 by cleat head 198 secures a region of first pod 126 in place.

As with first cleat 170, each of the remaining cleats preferably include a cleat fastener and a cleat head. This allows the remaining cleats to fasten regions of the pods in place in a manner similar to the way that first cleat 170 fastens a portion of first pod 126 into place. In particular, second cleat 172 is inserted through second through-hole 142 and engages second hole 110. In a similar manner, third cleat 174 is inserted through third through-hole 144 and engages third hole 112. In a similar manner, fourth cleat 176 is inserted through fourth through-hole 145 and engages fourth hole 113. In a similar manner, fifth cleat 178 is inserted through fifth through-hole 146 and engages fifth hole 116. Through the use of first cleat 170, second cleat 172, third cleat 174, fourth cleat 176, and fifth cleat 178, first pod 126 is fixed to outsole 102.

In a similar manner, sixth cleat 180 and seventh cleat 182 are preferably used to fasten second pod 128 to outsole 102. In particular, sixth cleat 180 is inserted through sixth through-hole 148 and engages sixth hole 118. In a similar manner, seventh cleat 182 is inserted through seventh through-hole 150 and engages seventh hole 119. Through the use of sixth cleat 180 and seventh cleat 182, second pod 128 may be fixed to outsole 102.

Figure 4:
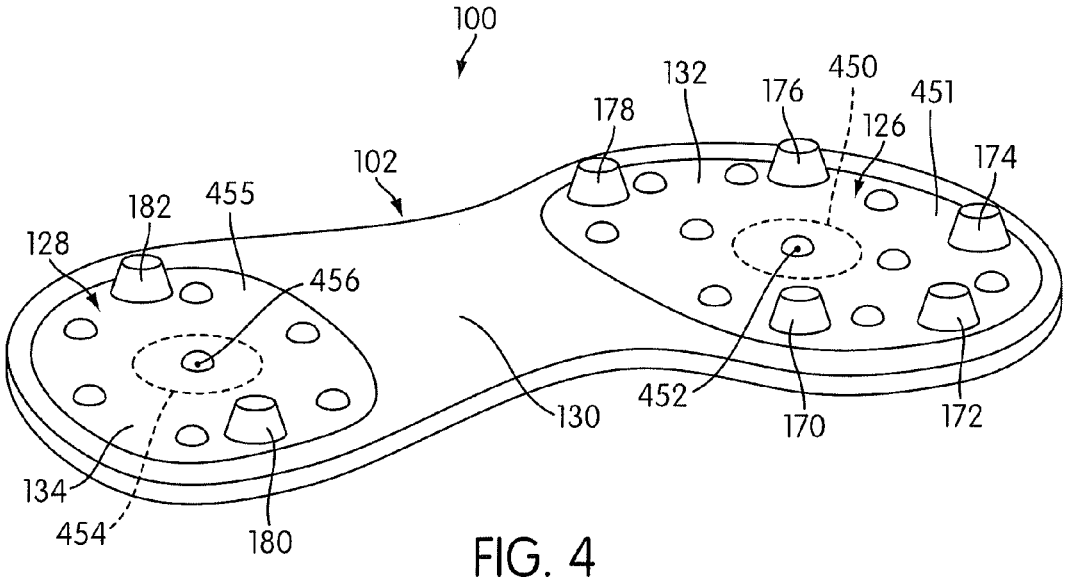
FIG. 4 is an isometric view of a preferred embodiment of an assembled interchangeable pod system.

FIG. 4 is an isometric view of a preferred embodiment of interchangeable pod system 100, after first pod 126 and second pod 128 have been fastened to outsole 102 by means of first cleat 170, second cleat 172, third cleat 174, fourth cleat 176, fifth cleat 178, sixth cleat 180, and seventh cleat 182. In this embodiment, first pod outer face 132 is flush with outsole outer face 130. Additionally, second pod outer face 134 is flush with outsole outer face 130. In some embodiments, first pod outer face 132 and second pod outer face 134 need not be flush with outsole outer face 130. Additionally, first pod 126 and heel pod 128 will not turn in place because they have been fastened to outsole 102 in multiple regions.

Preferably, first pod 126 includes first central portion 450 and first peripheral portion 451. In particular, first central portion 450 may be associated with, and include, first centroid 452 of first pod 126. In a preferred embodiment, cleats 172, 174, 176 and 178 may be disposed in first peripheral portion 451. Additionally, second pod 128 may include second central portion 454 and second peripheral portion 455. In particular, second central portion 454 may be associated with, and include, second centroid 456 of second pod 128. In a preferred embodiment, cleats 180 and 182 may be disposed in second peripheral portion 455. This arrangement generally increases the strength of the pod-outsole attachment, since pods 126 and 128 may be attached to outsole 102 at their peripheral portions 451 and 455.

Figure 5:
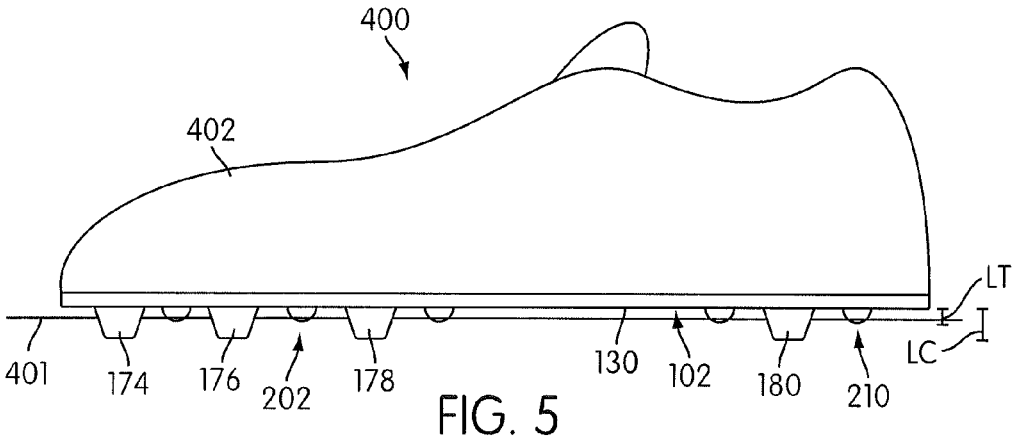
FIG. 5 is a side view of a preferred embodiment of an article of footwear.

The differences in the types of traction that pods and cleats may provide between an article of footwear and a given surface are best illustrated with reference to FIG. 5. FIG. 5 is a side view of a preferred embodiment of an article of footwear 400 in contact with a surface 401. Surface 401 may be any type of surface, including, but not limited to, grass, Astroturf®, or any surface that is porous enough to receive a cleat.

Article of footwear 400 includes upper 402. Upper 402 may be constructed of any material. In some embodiments, upper 402 may be constructed of leather and/or a synthetic material. In some embodiments, upper 402 may be constructed of many different materials. Article of footwear 400 further includes outsole 102. As seen in FIG. 5, outsole 102 includes first tread configuration 202 and second tread configuration 210. Outsole 102 further includes third cleat 174, fourth cleat 176, fifth cleat 178, and sixth cleat 180. First cleat, second cleat, and seventh cleat are also attached to outsole 102.

As measured from outer surface 130 of outsole 102, cleats 174, 176, 178 and 180 are seen to extend further than any of the tread elements of first tread configuration 202 and second tread configuration 210. The tread elements extend a distance LT, the length of the tread elements, from outsole 102. Each cleat 174, 176, 178 and 180 extends a distance LC, the length of the cleats, from outsole 102. LC is seen to be greater than LT in FIG. 5.

In particular, first tread configuration 202 and second tread configuration 210, each including individual tread elements, may slightly penetrate surface 401. Additionally, third cleat 174, fourth cleat 176, fifth cleat 178, and sixth cleat 180 have penetrated further into surface 401. The first cleat, second cleat, and seventh cleats may also penetrate into surface 401. In this way, traction is applied differently between article of footwear 400 and surface 401 through cleats and tread elements.

Though articles of footwear are often expensive, the pod sets and cleat sets can be significantly cheaper. Therefore the intended user need only purchase one article of footwear, and can purchase many different pod sets and cleat sets. This allows the user a wide range of variations in traction for the article of footwear by the modification of the outsole. Additionally, since changing from one cleat set and pod set to another is easy, the user can make these modifications at any time. If rain develops just before a game begins, the user of the interchangeable pod system can easily make adjustments to their article of footwear in an attempt to provide the most effective type of traction for this situation.

Figure 6:
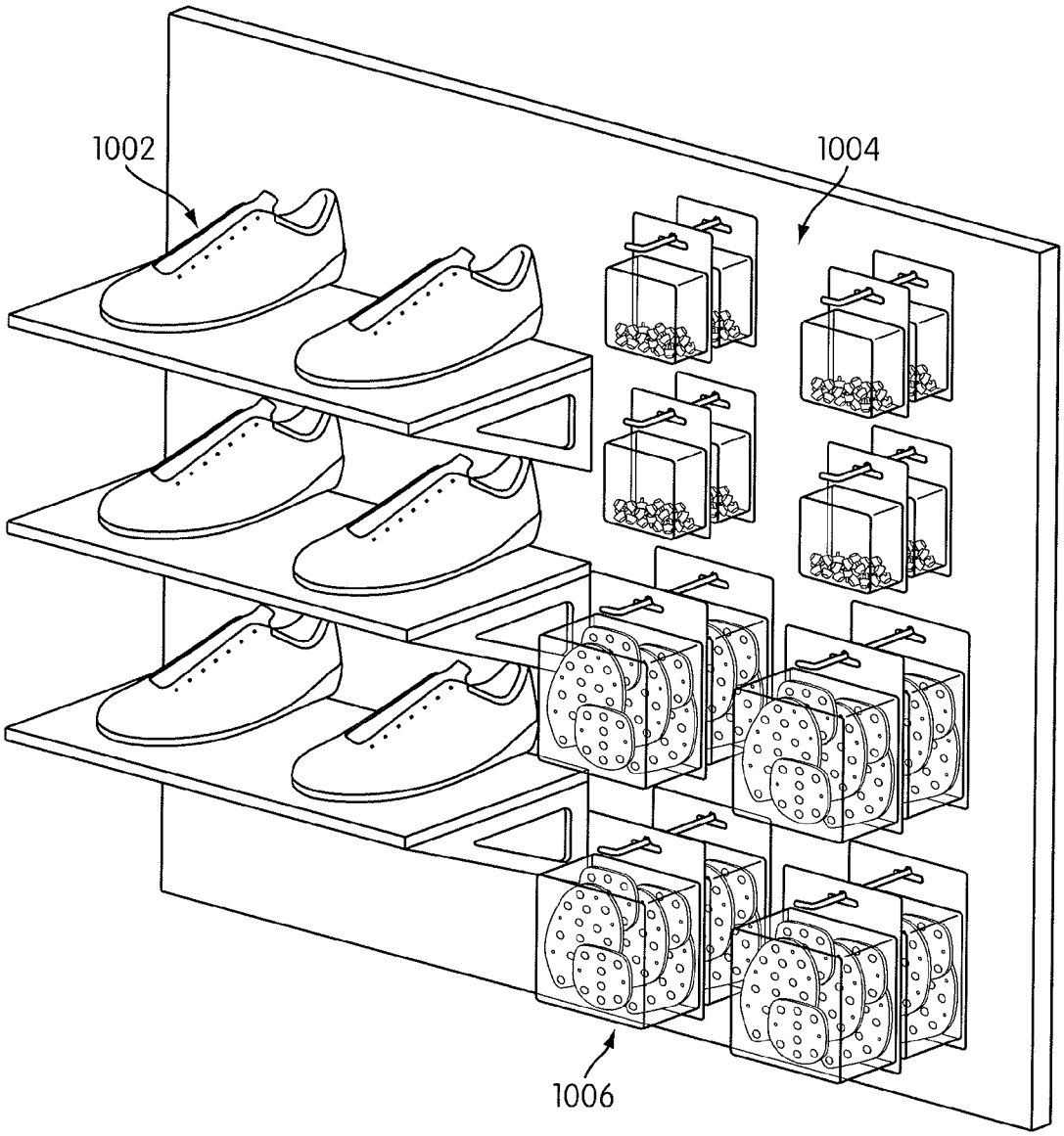
FIG. 6 is an isometric view of a preferred embodiment of a retail system.

FIG. 6 shows a preferred embodiment of retail system, in which articles of footwear 1002 are sold simultaneously with pre-packaged cleat sets 1004 and pre-packaged pod sets 1006. In this embodiment, the retail system is a section of a wall. In a preferred embodiment, this wall would be a portion of a retail store. Articles of footwear 1002 are shown generically in FIG. 6 only for the purpose of illustration. In some embodiments, these articles of footwear may be different styles and colors.

Using a retail system, a user could purchase an article of footwear, select a pod set from the group of candidate pod sets that have been pre-packaged, and select a cleat set from a group of candidate cleat sets that have been pre-packaged. By associating a pod of the selected pod set with the outsole, and attaching that pod by using cleats from the selected cleat set, the user is able to modify the article of footwear themselves to provide varying degrees of traction.

In some situations, it may be preferable for a user to purchase multiple pre-packaged pod sets and pre-packaged cleat sets at one time. Using a retail system, like that shown in FIG. 6, a user could purchase a member of articles of footwear 1002, three different members of pre-packaged cleat sets 1004, and three different members of pre-packaged pod sets 1006. This would give them nine different variations in the type of traction that could be obtained through the modification of the article of outsole. Additionally, the pre-packaged cleat sets 1004 and the pre-packaged pod sets 1006 are easily portable in the sense that they are small compared to the size of articles of footwear 1002, which are already transported by the user. This feature allows the user to modify the outsole of the article of footwear at any time.

The type of cleats and pods to be used with an article of footwear may be chosen on the basis of several factors. First, knowing the surface on which footwear will be used is of primary importance in determining the type of cleats and tread elements to be used. In addition to knowing the type of surface, it may be important to know the conditions of the surface as well. In this way, an article of footwear may be configured to maximize performance for a specific type of surface and a specific set of surface conditions. Different surfaces may require the use of different types of cleats and tread elements. Likewise, different surface conditions may require the use of different types of cleats and tread elements. Additional factors include the weight of the user, the position of the sport they play, as well as the style of play of the user.

For clarity, the following detailed description discusses the selection of footwear based on surface type and surface conditions. However, it should be kept in mind that the additional factors of weight, position, and style of play, mentioned above, may also be important in selecting the type of cleats and pods to be used in a given situation.

With traditional footwear, the user must purchase several different types of footwear in order to ensure maximum performance in a variety of conditions. Often, footwear is expensive. Using an interchangeable pod system, the user may purchase just one article of footwear, and purchase separate pods and cleats. This allows the user to easily interchange the tread elements and types of cleats to be used in order to maximize performance in a given setting.

Figure 7:
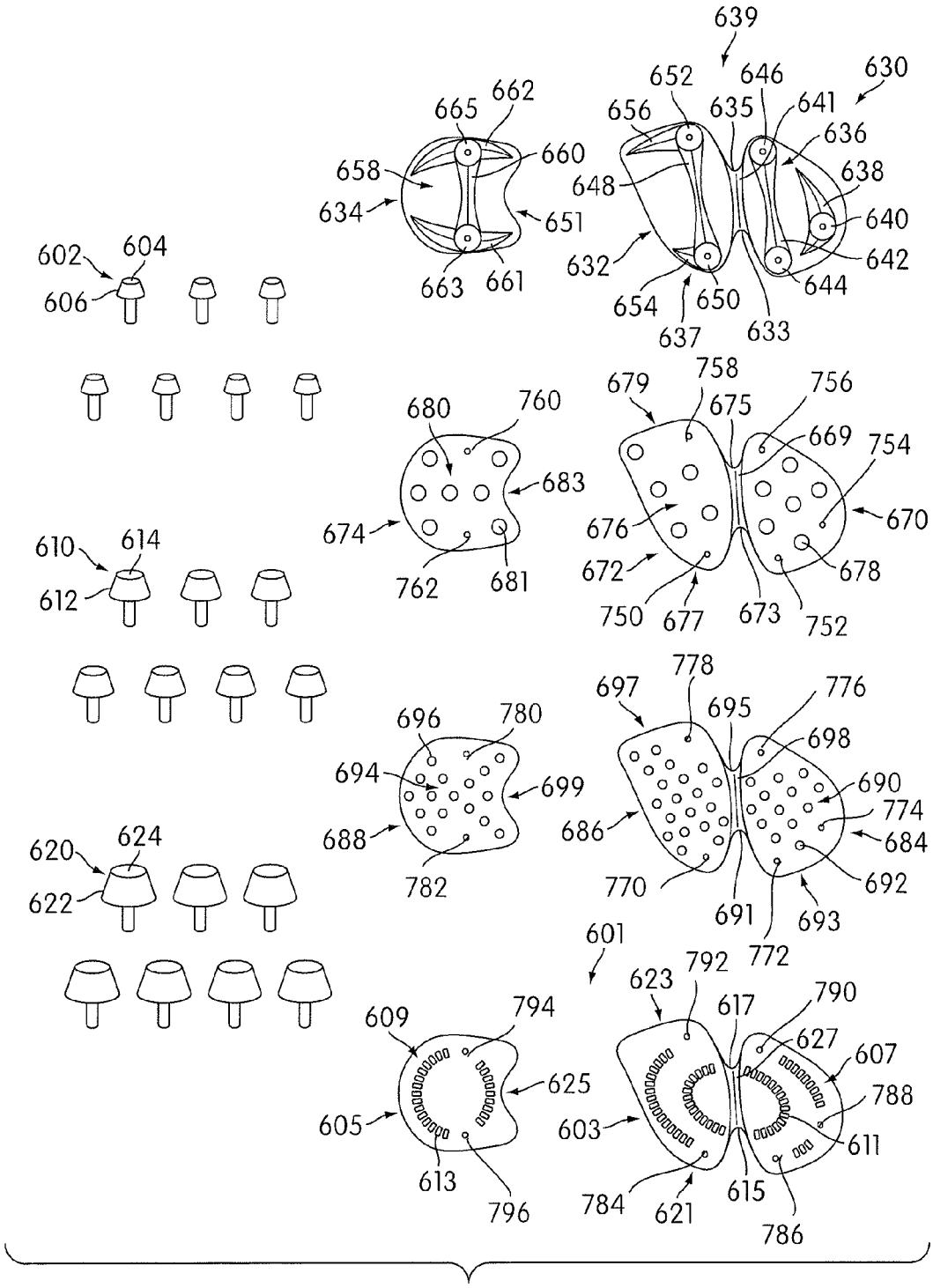
FIG. 7 is a view of a preferred embodiment of several pod sets and several cleat sets.

FIG. 7 is a preferred embodiment of several cleat sets and several pod sets. First cleat set 602, second cleat set 610, and third cleat set 620 are three distinct types of cleat sets. As seen here, each of the three cleats are different sizes. First cleat set 602 includes first cleat 604. First cleat 604 includes first cleat head 606. In a preferred embodiment, the remaining six cleats in first cleat set 602 are substantially similar to first cleat 604 in all respects. Second cleat set 610 includes second cleat 612. Second cleat 612 includes second cleat head 614. Preferably, second cleat head 614 is longer than first cleat head 606. In a preferred embodiment, the remaining six cleats in second cleat set 610 are substantially similar to second cleat 612 in all respects. Third cleat set 620 includes third cleat 622. Third cleat 622 includes third cleat head 624. Preferably, third cleat head 624 is longer than both first cleat head 606 and second cleat head 614. In a preferred embodiment, the remaining six cleats in third cleat set 620 are substantially similar to third cleat 622 in all respects.

In addition to differences in the size of the cleat heads, each cleat set may also differ in material composition. In general, any two cleat sets may be considered as distinct, and therefore potentially useful for different surfaces and/or surface conditions, if they are different in any way. These differences include size and material composition.

In general, small cleats, like first cleat set 602, are often used on artificial surfaces, such as Astroturf®. Larger cleats, like third cleat set 620, are often used on high grass. Medium sized cleats, like second cleat set 610, are often used on low natural grass or low synthetic grass.

Although only three cleat sets are shown here, interchangeable pod system 100 may include any number of cleat sets. In addition, though each cleat set may be designed with a specific surface and set of surface conditions in mind, the cleat sets need not be used for the surfaces and surface conditions for which they were originally designated.

Also seen in FIG. 7 are embodiments of several pod sets. In these embodiments, each pod set consists of a forefoot pod and a heel pod. Additionally, each pod set consists of different tread configurations that, like the various types of cleats, are each suited to a specific kind of surface and/or surface condition.

In some embodiments, first pod set 630 includes first forefoot pod 632 and first heel pod 634. First forefoot pod 632 includes first forefoot tread configuration 636. As seen in FIG. 7, first forefoot tread configuration 636 includes first tread ridge 638. First tread ridge 638 is disposed around first pod through-hole 640. Additionally, first forefoot pod 632 includes second tread ridge 642, which is disposed between second pod through-hole 644 and third pod through-hole 646. First forefoot pod 632 further includes third tread ridge 648, which is disposed between fourth pod through-hole 650 and fifth pod through-hole 652. In some embodiments, first forefoot pod 632 may include first lateral tread ridge 656 and first medial tread ridge 654, each disposed perpendicular to third tread ridge 648.

Some embodiments may include a provision that allows the first pod to bend in a region that corresponds to the natural bend line of the foot. This provision may be a narrowed region of the forefoot pod that includes grooves to facilitate bending. In particular, each forefoot pod includes two regions, a first region that is a grooved region, and a second region that is a non-grooved region of the pod, such that the grooved region is more flexible than the non-grooved region.

In a preferred embodiment, first forefoot pod 632 includes first indentation region 633 disposed along medial side 637. Likewise, first forefoot pod 632 preferably includes second indentation region 635, disposed along lateral side 639. Also, first forefoot pod 632 preferably includes grooved region 641 disposed between first indentation region 633 and second indentation region 635. First indentation region 633, second indentation region 635, and grooved region 641 are all configured in a manner that allows first forefoot pod 632 to bend along grooved region 641. This region of bending preferably coincides with the natural bend line of the foot, disposed along the forefoot. Using this configuration, an article of footwear may have increased flexibility in the forefoot region over pods that do not include indentations and a grooved region.

First heel pod 634 preferably includes first heel tread configuration 658. As seen in FIG. 7, first heel tread configuration 658 includes fourth tread ridge 660. Fourth tread ridge 660 is disposed around and between sixth pod through-hole 663 and seventh pod through hole 665. In some embodiments, first heel pod 634 includes second lateral tread ridge 662 and second medial tread ridge 661, each disposed perpendicular to fourth tread ridge 660.

Preferably, first heel pod 634 includes provisions for facilitating flexibility of the arch region of an article of footwear. In some embodiments, first heel pod 634 includes first heel indent 651. Using this configuration, the arch region of the outsole may be more flexible than it would otherwise be if first heel pod 634 extended into or nearer to the arch region of the outsole.

In some embodiments, first pod set 630 may be used on artificial surfaces, such as Astroturf®. Generally, first pod set 630 may be used on dry surfaces. However, it should be understood that first pod set 630 need not be used on artificial surfaces or in dry conditions.

Preferably, second pod set 670 includes second forefoot pod 672 and second heel pod 674. Second forefoot pod 672 includes second forefoot tread configuration 676. As seen in FIG. 7, second forefoot tread configuration 676 includes first tread element 678. In some embodiments, first tread element 678 may be hemispheric in shape. In other embodiments, first tread element 678 may be another shape. In a preferred embodiment, second forefoot tread configuration 676 includes additional tread elements. These tread elements may be widely spaced. That is, the spacing between tread elements may be several times the length of the diameter of the tread elements themselves.

As discussed previously, second forefoot pod 672 may include a region that bends easily. Second forefoot pod 672 preferably includes first indentation region 673 located along medial side 677 of second forefoot pod 672. Likewise, second forefoot pod 672 preferably includes second indentation region 675, located along lateral side 679 of second forefoot pod 672. Also, second forefoot pod 672 preferably includes grooved region 669 disposed between first indentation region 673 and second indentation region 675. First indentation region 673, second indentation region 675, and grooved region 669 are all configured in a manner that allows first forefoot pod 672 to bend along grooved region 669. This region of bending coincides with the natural bend line of the foot, located in the forefoot. Using this configuration forefoot pod 670 may help provide further flexibility to the forefoot region of an article of footwear.

Preferably, second forefoot pod 670 also includes provisions similar to those included in first forefoot pod for engaging cleats. In particular, second forefoot pod 670 preferably includes first through-through hole 750, second through-hole 752, third through-hole 754, fourth through-hole 756, and fifth through-hole 758. Second heel pod 674 also preferably includes sixth through-hole 760 and seventh through-hole 762. Second heel pod 674 may also include second heel indent 683. In a similar manner to first heel indent 651, second heel indent 683 preferably allows increased flexibility along the arch region of an article of footwear.

Second heel pod 674 preferably includes second heel tread configuration 680. As seen in FIG. 7, second heel tread configuration 680 preferably includes second tread element 681. Second tread element 681 may be hemispheric in shape. In some embodiments, second tread element 681 may be similar in size and shape to first tread element 678. In a preferred embodiment, second heel tread configuration 680 includes multiple tread elements. Each tread element may be identical in size and shape to second tread element 681. These tread elements may be widely spaced. That is, the spacing between tread elements may be several times the length of the diameter of the tread elements themselves. In some embodiments, some tread element disposed along second heel tread configuration 680 be differ in size and shape from second tread element 681.

In some embodiments, second pod set 670 may be useful on a surface such as grass, in dry conditions. In other embodiments, second pod set 670 may be useful on other surfaces.

Third pod set 686 preferably includes third forefoot pod 686 and third heel pod 688. Third forefoot pod 686 preferably includes third forefoot tread configuration 690. As seen in FIG. 7, third forefoot tread configuration 690 includes third tread element 692. In some embodiments, third tread element 692 may be hemispheric in shape. In other embodiments, third tread element 692 may be another shape. In a preferred embodiment, third forefoot tread configuration 690 includes additional tread elements. In some embodiments, these tread elements may be narrowly spaced. That is, the spacing between tread elements may be equal to, or smaller than, the length of the diameter of the tread elements themselves.

As discussed previously, third forefoot pod 686 may include a region that bends easily. Third forefoot pod 686 preferably includes first indentation region 691 located along medial side 693 of third forefoot pod 686. Likewise, third forefoot pod 686 preferably includes second indentation region 695, located along lateral side 697 of third forefoot pod 686. Also, third forefoot pod 686 preferably includes grooved region 698 disposed between first indentation region 691 and second indentation region 695. First indentation region 691, second indentation region 695, and grooved region 698 are all configured in a manner that allows first forefoot pod 686 to bend along grooved region 698. This region of bending coincides with the natural bend line of the foot, located in the forefoot. Using this configuration, forefoot pod 686 may help provide further flexibility to the forefoot region of an article of footwear.

Third heel pod 688 preferably includes third heel tread configuration 694. As seen in FIG. 7, third heel tread configuration 694 preferably includes fourth tread element 696. Fourth tread element 696 may be hemispheric in shape. In some embodiments, fourth tread element 696 may be similar in size and shape to third tread element 692. In a preferred embodiment, fourth heel tread configuration 694 includes multiple tread elements. Each tread element may be identical in size and shape to fourth tread element 696. In some embodiments, these tread elements may be narrowly spaced. That is, the spacing between tread elements may be equal to, or smaller than, the length of the diameter of the tread elements themselves. In some embodiments, various tread elements disposed along third heel tread configuration 694 may differ in size and shape from fourth tread element 696.

Preferably, third forefoot pod 686 and third heel pod 688 may include provisions for inserting a cleat in order to attach each pod 686 and 688 to an outsole. In a preferred embodiment, third forefoot pod 686 also preferably includes first through-hole 770, second through-hole 772, third through-hole 774, fourth through-hole 776, and fifth through-hole 778. Additionally, third heel pod 688 also preferably includes sixth through-hole 780 and seventh through-hole 782.

In some embodiments, the surface area of heel pod 688 may be reduced to facilitate flexibility along the arch of the article of footwear. In some embodiments, third heel pod 688 may include third heel indent 699. In this manner, third heel pod 688 may interfere less with the flexibility of the footwear along the arch region.

In some embodiments, third pod set 684 may be useful on a surface such as grass, in wet conditions. In other embodiments, second pod set 684 may be useful on other surfaces.

Fourth pod set 601 preferably includes fourth forefoot pod 603 and fourth heel pod 605. Fourth forefoot pod 603 preferably includes fourth forefoot tread configuration 607. As seen in FIG. 7, fourth forefoot tread configuration 607 includes fifth tread element 611. In some embodiments, fifth tread element 611 may be rectangular in shape. In other embodiments, fifth tread element 611 may be another shape. In a preferred embodiment, fifth forefoot tread configuration 607 includes additional tread elements. These tread elements may be configured in circular or semi-circular patterns.

In a preferred embodiment, fourth forefoot pod 603 includes first indentation region 615 located along medial side 621 of fourth forefoot pod 603. Likewise, fourth forefoot pod 603 preferably includes second indentation region 617, located along lateral side 623 of fourth forefoot pod 603. Also, fourth forefoot pod 603 preferably includes grooved region 627 disposed between first indentation 615 and second indentation 617. First indentation region 615, second indentation region 617, and grooved region 627 are all configured in a manner that allows fourth forefoot pod 603 to bend along grooved region 627. This region of bending coincides with the natural bend line of the foot, located in the forefoot. Using this configuration, forefoot pod 603 may help provide further flexibility to the forefoot region of an article of footwear.

Fourth heel pod 605 preferably includes fourth heel tread configuration 609. As seen in FIG. 7, fourth heel tread configuration 609 preferably includes sixth tread element 613. Sixth tread element 613 may be hemispheric in shape. In some embodiments, sixth tread element 613 may be similar in size and shape to fifth tread element 611. In a preferred embodiment, fourth heel tread configuration 609 includes multiple tread elements. Each tread element may be identical in size and shape to sixth tread element 613. In some embodiments, various tread element disposed along fourth heel tread configuration 609 may differ in size and shape from sixth tread element 613. In some embodiments, these tread elements may be configured in a circular or semi-circular pattern.

Preferably, fourth forefoot pod 603 and fourth heel pod 605 may include provisions for inserting a cleat in order to attach each pod 603 and 605 to an outsole. In a preferred embodiment, fourth forefoot pod 603 includes first through-hole 784, second through-hole 786, third through-hole 788, fourth through-hole 790, and fifth through-hole 792. Additionally, in a preferred fourth heel pod 605 preferably includes sixth through-hole 794 and seventh through-hole 796.

In some embodiments, the surface area of heel pod 605 may be reduced to facilitate flexibility along the arch of the article of footwear. In some embodiments, fourth heel pod 605 may include fourth heel indent 625. In this manner, fourth heel pod 605 may interfere less with the flexibility of the footwear along the arch region.

In some embodiments, fourth pod set 601 may be useful on a surface such as grass, in wet conditions. Fourth pod set 601 has an aggressive tread configuration similar to third pod set 684, and may be used on similar surfaces and in similar surface conditions.

Although three distinct cleats sets and four distinct pod sets are seen in FIG. 7, in some embodiments there could be any number of distinct cleat sets and distinct pod sets.

Figure 8:
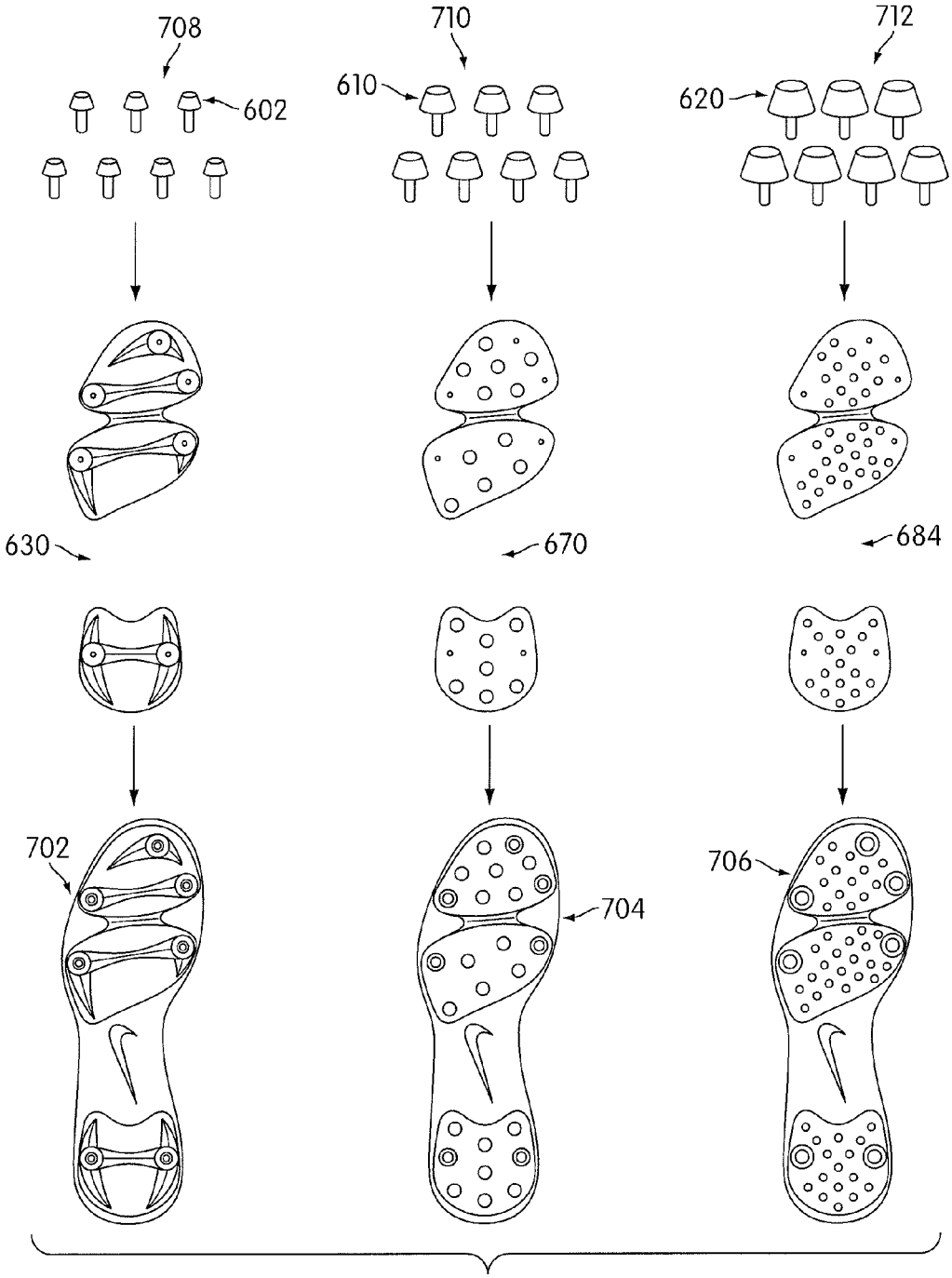
FIG. 8 is a schematic view of a preferred embodiment of possible configurations using an interchangeable pod system.

As different cleat sets may be configured for specific surfaces and/or surface conditions and different pod sets may also be configured for specific surfaces and/or surface conditions, particular combinations of cleat sets and pod sets may be more natural than others. FIG. 8 is a schematic diagram of a preferred embodiment of three different configurations of an article of footwear using interchangeable pod system 100. In a first configuration 708, first cleat set 602 is combined with first pod set 630. First cleat set 602, as previously discussed, may be used on artificial surfaces, such as Astroturf®. Likewise, first pod set 630 may also be used on artificial surfaces. The final product is shown as first modified outsole 702. First modified outsole 702 is configured so that the article of footwear is most effective on surfaces that do not allow or require long tread elements or aggressive tread patterns. Examples of such surfaces may include any synthetic surfaces, in primarily dry conditions.

In a second configuration 710, second cleat set 610 may be combined with second pod set 670. Second cleat set 610 may be used on surfaces such as low grass. Likewise, second pod set 670 may be used on low grass that is dry. The final product is shown as second modified outsole 704. Second modified outsole 704 is configured so that the article of footwear is most effective on surfaces such as grass, specifically in dry conditions.

In a third configuration 712, third cleat set 620 is combined with third pod set 684. Third cleat set 620 may be used on high grass. An example of such a surface is wet grass. Likewise, third pod set 684 may be used on high grass that is wet, or some other surface that requires an aggressive tread configuration. The final product is shown as third modified outsole 706. Third modified outsole 706 is configured so that the article of footwear is most effective in wet high grass, or on other surfaces that require a great deal of traction.

In the previous embodiments, a small cleat set was combined with a ridged tread configuration pod set. Likewise, a medium cleat set was combined with a medium traction pod set. Likewise, a long cleat set was combined with a pod set that included an aggressive tread configuration. In some situations, however, it may be beneficial to use a small cleat set with a medium traction pod set, for example.

Figure 9:
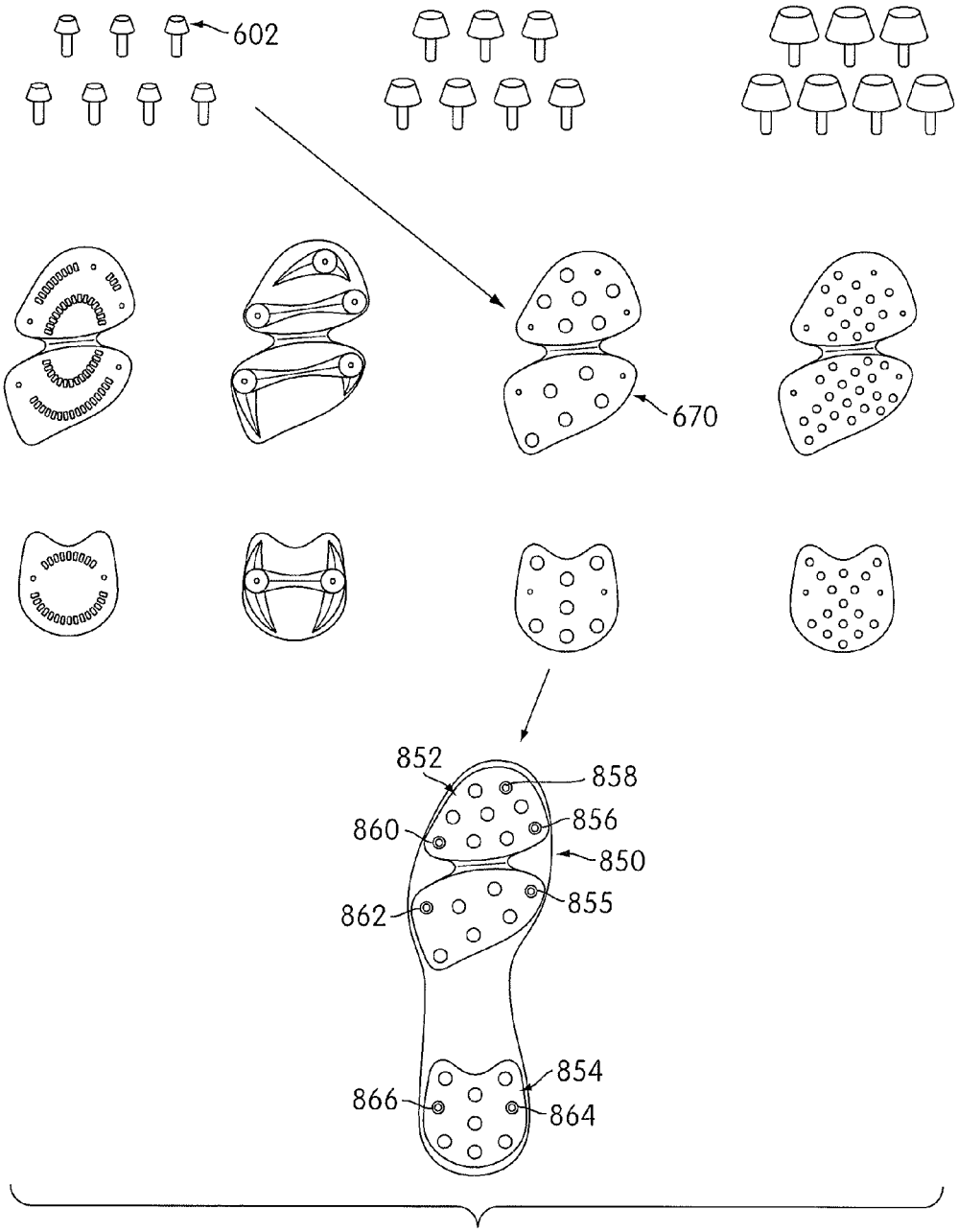
FIG. 9 is a schematic view of a preferred embodiment of a possible configuration using an interchangeable pod system.

FIG. 9 is a schematic representation of a preferred embodiment of first cleat set 602 combined with second pod set 670 to form modified outsole 850. Modified outsole 850 includes a first tread configuration 852 and a second tread configuration 854 that have been configured for normal conditions. Modified outsole 850 further includes first cleat 855, second cleat 856, third cleat 858, fourth cleat 860, fifth cleat 862, sixth cleat 864, and seventh cleat 866.

In the embodiments shown so far, three types of cleats have been shown, along with four types of pods. The number of distinct combinations using one cleat set and one pod set is 12. As the number of cleat sets and pod sets grows, the total number of possible combinations will also grow.

FIG. 10 shows a schematic representation of a preferred embodiment of the various combinations of three cleat sets with three pod sets. At the top of the second column is first cleat set 602. At the top of the third column is second cleat set 610. At the top of the fourth column is third cleat set 620. In addition to these three cleat sets, multiple cleat sets could be included. Here, nth cleat set 802 is shown to illustrate that there may be many different cleat sets, up to n different types.

At the beginning of the second row in FIG. 10 is first pod set 630. At the beginning of the third row is second pod set 670. At the beginning of the fourth row is third pod set 684. In addition to these three pod sets, multiple pod sets may be included. Here, nth pod set 804 is shown to illustrate that there may be many different pod sets, up to n different types.

Every possible combination of the three cleat sets with the three pod sets is shown in FIG. 10. Each combination represents a distinct modified outsole. First modified outsole 702 is seen under first cleat set 602 and across from first pod set 630. Second modified outsole 704 is seen under second cleat set 610 and across from second pod set 670. Third modified outsole 701 is seen under third cleat set 620 and across from third pod set 684. Also shown is modified outsole 806, which under nth cleat set 802 and across from nth pod set 804.

In addition to these combinations of cleat sets and pod sets that have already been described, it is also possible to form other combinations. Modified outsole 808, is seen in FIG. 10 to be a combination of third cleat set 620 and second pod set 670. Third cleat set 620 is a longer type of cleat, which may be used in high grass. Second pod set 670 may also be used in grass. Modified outsole 808 is therefore configured for high grass, but with a less aggressive tread configuration.

If there are four distinct cleat sets and four distinct pod sets, then there are sixteen distinct modified outsoles that can be formed. For five distinct cleat sets and five distinct pod sets there are twenty-five distinct modified outsoles that can be formed. Therefore, as the number of distinct cleat sets and the number of distinct pod sets increases, the total number of possible modified outsoles also increases. A larger group of possible modified outsoles allows the user of an article of footwear the ability to make more subtle adjustments that may increase performance for a given surface with a given set of surface conditions.

Manufacturing costs are an important consideration in the development of an interchangeable pod system. In the previous embodiment, the pods came in two types, a forefoot pod and a heel pod. This may require that manufacturing systems be set up to produce two different types of pods. It may be preferable to design an interchangeable pod system that requires the use of only one type of pod. This will allow for a reduction in manufacturing costs.

Figure 11:
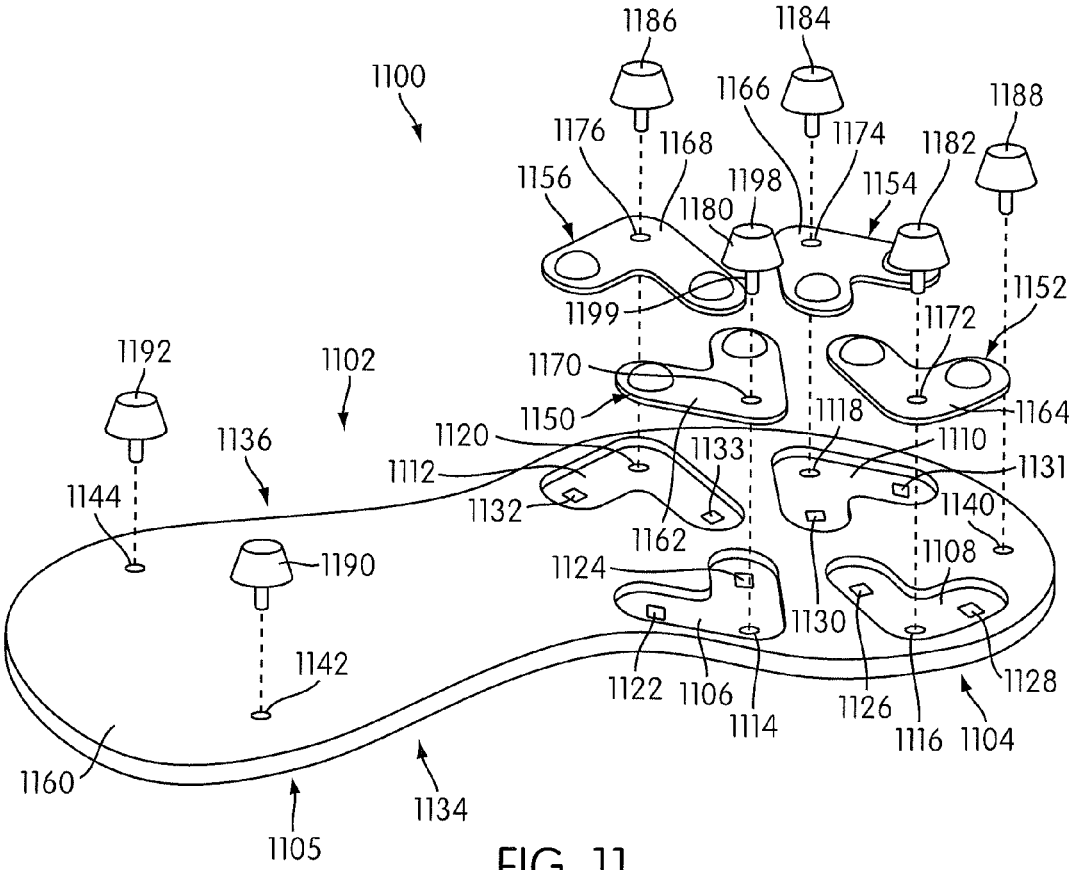
FIG. 11 is an exploded isometric view of a preferred embodiment of an interchangeable pod system.

FIG. 11 is an isometric view of the preferred embodiment of interchangeable pod system 1100, which makes use of substantially similar pods to reduce manufacturing costs. Interchangeable pod system 1100 includes outsole 1102. Outsole 1102 is usually integrated into an article of footwear. Outsole 1102 need not be detachable from an article of footwear. Here, outsole 1102 is shown in isolation in order to emphasize the preferred components of interchangeable pod system 1100. Outsole 1102 may be constructed from any material. Outsole 1102 can also be any shape, including various thicknesses and styles. In FIG. 11, outsole 1102 is seen to be generic for the purposes of illustration, but in some embodiments outsole 1102 will be designed to meet the aesthetic and performance needs of a particular article of footwear.

Preferably, outsole 1102 includes a forefoot portion 1104 and a heel portion 1105. Forefoot portion 1104 preferably includes first mounting region 1106, second mounting region 1108, third mounting region 1110, and fourth mounting region 1112. First mounting region 1106, second mounting region 1108, third mounting region 1110, and fourth mounting region 1112 may be any size and shape. In some embodiments, first mounting region 1106, second mounting region 1108, third mounting region 1110, and fourth mounting region 1112 may be non-circularlualar in shape. In some embodiments, first mounting region 1106, second mounting region 1108, third mounting region 1110, and fourth mounting region 1112 may be V-shaped. In a preferred embodiment, first mounting region 1106, second mounting region 1108, third mounting region 1110, and fourth mounting region 1112 are substantially similar in size and shape. Although four recessed regions are included in this embodiment, in general there can be any number of recessed regions included in outsole 1102.

These mounting regions are preferably configured to receive pods. In particular, first mounting region 1106 includes first hole 1114. Second mounting region 1108 includes second hole 1116. Third mounting region 1110 includes third hole 1118. Fourth mounting region 1112 includes fourth hole 1120. First hole 1114 and second hole 1116 are preferably disposed near a medial side 1134 of outsole 1102. Third hole 1118 and fourth hole 1120 are preferably disposed near a lateral side 1136 of outsole 1102. Additionally, first mounting region 1108 includes first slot 1122 and second slot 1124. Second mounting region includes third slot 1126 and fourth slot 1128. Third mounting region includes fifth slot 1130 and sixth slot 1131. Fourth mounting region includes a seventh slot 1132 and eighth slot 1133. Outsole 1102 further includes fifth hole 1140, which is preferably disclosed at the tip of forefoot portion 1104. Preferably, heel portion 1105 also includes sixth hole 1142 and seventh hole 1144. Although this embodiment includes seven holes in outsole 1102, other embodiments may include any number of holes.

In addition to outsole 1102, interchangeable pod system 1100 preferably includes pods. These pods may include multiple tread elements that form tread configurations. These tread configurations, when used simultaneously with cleats, allow a user to configure an article of footwear to include a desired amount of friction.

In a preferred embodiment, interchangeable pod system 1100 includes first pod 1150, second pod 1152, third pod 1154, and fourth pod 1156. In some embodiments, first pod 1150, second pod 1152, third pod 1154, and fourth pod 1156 may be constructed of a rubber material or a synthetic plastic. In some embodiments, first pod 1150, second pod 1152, third pod 1154, and fourth pod 1156 may be constructed of different materials from rubber or plastic. In some embodiments, first pod 1150, second pod 1152, third pod 1154, and fourth pod 1156 may be constructed of the same material. In some embodiments, there may be a different number of pods than four. In addition to varying the material composition of the pods, the number of pods used with an article of footwear may also be varied in other embodiments. In some embodiments, there may be a different number of pods than four.

In general, pods may be attached to an outsole of an article of footwear via mounting regions. In a preferred embodiment, first mounting region 1106, second mounting region 1108, third mounting region 1110, and fourth mounting region 1112 are preferably configured to receive first pod 1150, second pod 1152, third pod 1154, and fourth pod 1156, respectively. In some embodiments, outsole outer face 1160 may be flush with first pod outer face 1162, second pod outer face 1164, third pod outer face 1166, and fourth pod outer face 1168. In some embodiments, first pod outer face 1160 may be raised with respect to first pod outer face 1162, second pod outer face 1164, third pod outer face 1166, and fourth pod outer face 1168.

First pod 1150 preferably includes first through-hole 1170. Second pod 1152 preferably includes second through-hole 1172. Third pod 1154 preferably includes third through-hole 1174. Fourth pod 1156 preferably includes fourth through-hole 1176. Preferably, first through-hole 1170, second through-hole 1172, third through-hole 1174 and fourth through-hole 1176 are disposed along first pod 1150, second pod 1152, third pod 1154, and fourth pod 1156 in a manner that allows them to be in alignment with first hole 1114, second hole 1116, third hole 1118, and fourth hole 1120 respectively. In particular, first through-hole 1170, second through-hole 1172, third through-hole 1174, and fourth through-hole 1176 are preferably constructed in such a way that a small fastener could be inserted through each through-hole.

Each pod set preferably includes a distinct type of tread configuration. Different tread configurations may be used to accomplish varying degrees of traction, which is a desirable property since different surfaces often require different degrees of traction in order for the user to achieve maximum performance.

Figure 12:
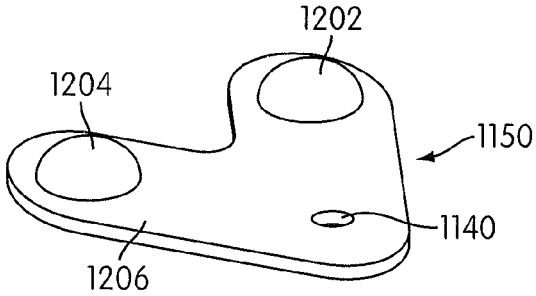
FIG. 12 is an isometric view of a preferred embodiment of a first side of a pod.

FIG. 12 is an isolated isometric view of a preferred embodiment of a first side 1206 of first pod 1150. First pod 1150 includes first tread element 1202 and second tread element 1204. In this embodiment, first tread element 1202 and second tread element 1204 are hemispheric in shape, but in other embodiments they may be any size and shape. In some embodiments, first tread element 1202 and second tread element 1204 may be constructed of the same material. In some embodiments, first tread element 1202 and second tread element 1204 may be constructed of different materials.

Figure 13:
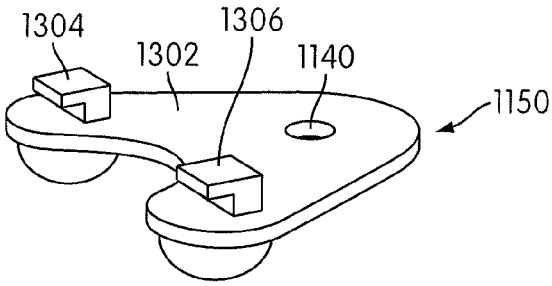
FIG. 13 is an isometric view of a preferred embodiment of a second side of a pod.

FIG. 13 is an isolated view of a preferred embodiment of a second side 1302 of first pod 1150. Second side 1302 preferably includes first mechanical connector 1304 and second mechanical connector 1306. First tab 1304 and second tab 1306 are preferably configured to be inserted into first slot 1122 and second slot 1124, seen in FIG. 12. In a preferred embodiment, first mechanical connector 1304 and second mechanical connector 1306 may be tabs.

All aspects of first pod 1150 described here preferably apply to second pod 1152, third pod 1154, and fourth pod 1156. These pods are preferably substantially similar in all aspects. Thus, interchangeable pod system 1100 is preferably designed so that a manufacturing system need only produce one type of pod. This feature may save manufacturing costs.

Cleats are used in articles of footwear to provide traction on surfaces that may be deformed during use. The longer length and pointed shape of a cleat, as opposed to a tread element, allows the cleat to insert deep into the surface, providing additional traction beyond the level of friction achieved by using tread elements alone. For this reason, it is preferable that an interchangeable pod system include cleats as well as tread elements.

As seen in FIG. 11, interchangeable pod system 1100 preferably includes first cleat 1180, second cleat 1182, third cleat 1184, fourth cleat 1186, fifth cleat 1188, sixth cleat 1190, and seventh cleat 1192. First cleat 1180 also includes cleat head element 1198 and cleat fastener 1199. In general, the number of cleats included in interchangeable pod system 1100 can be different than seven. Some embodiments may include less than seven cleats, while other embodiments may include more than seven cleats.

Figure 14:
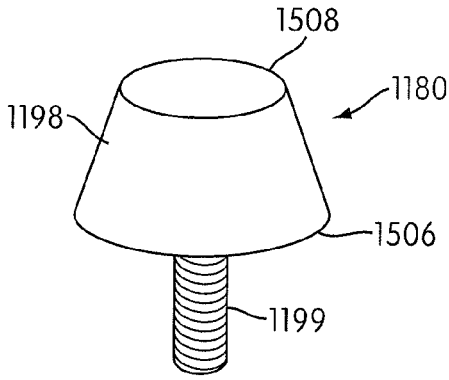
FIG. 14 is an isometric view of a preferred embodiment of a cleat.

FIG. 14 is an isolated view of a preferred embodiment of first cleat 1180. Preferably, first cleat 1180 includes cleat head 1198, as well as cleat fastener 1199. Cleat head 1198 may be constructed of any material, including, but not limited to, rubber, hard plastic, or metal. Preferably, cleat head 1198 is widest at cleat base 1506 and narrowest at cleat tip 1508. This allows first cleat 1180 to efficiently penetrate into surfaces during use. Cleat fastener 1199 is preferably made of a durable material that will not break while cleat 1180 is engaged with a surface. In particular, cleat fastener 1199 may be threaded in some embodiments, like a screw, or include some portion that is threaded. This feature allows first cleat 1180 to be fastened to outsole 1102. In some embodiments, cleat fastener 1199 may include another mechanism by which cleat 1180 may be fastened into outsole 1102.

All aspects of first cleat 1180 described here preferably apply to second cleat 1182, third cleat 1184, fourth cleat 1186, fifth cleat 1188, sixth cleat 1190, and seventh cleat 1192 as well.

A key advantage of the present disclosure is the ease with which the pods may be assembled to the outsole of the article of footwear through the use of removable cleats. Referring to FIG. 11, first cleat 1180 is designed to insert through first through-hole 1170 and engage first hole 1114. In particular, cleat fastener 1199 extends through first through-hole 1170 and engages first hole 1114. In some embodiments, first hole 1114 may include threading that engages with threading in cleat fastener 1199, so that first cleat 1180 may be screwed into outsole 1102. In some embodiments, there may be other mechanisms by which cleat fastener 1199 engages with first hole 1114 to attach first cleat 1180 to outsole 1102. Preferably, first through-hole 1170 is just large enough so that cleat fastener 1199 can be inserted, but small enough so that cleat head 1198 can not be inserted through first through-hole 1170. As first cleat 1180 is fastened to outsole 1102, cleat head 1198 imposes a force on first pod outer face 1160. The compressive force applied to first pod outer face 1160 by cleat head 1198 secures first pod 1150 in place. Additionally, first mechanical connector 1304 and second mechanical connector 1306 of first pod 1150 engage first slot 1122 and second slot 1124 of first mounting region 1106, providing an additional force that helps to secure first pod 1150 in place.

As with first cleat 1180, each of the remaining cleats include a cleat fastener and a cleat head. This allows the remaining cleats to fasten each of the pods in place in a manner similar to the way that first cleat 1180 fastens a portion of first pod 1150 into place. In particular, second cleat 1182 is inserted through second through-hole 1172 and engages second hole 1116. In a similar manner, third cleat 1184 is inserted through third through-hole 1174 and engages third hole 1118. In a similar manner, fourth cleat 1186 engages fourth through-hole 1176 and engages fourth hole 1120.

Preferably, second pod 1152, third pod 1154, and fourth pod 1156 preferably include two mechanical connectors that are configured to engage with third mechanical connector slot 1126, fourth mechanical connector slot 1128, fifth mechanical connector slot 1130, sixth mechanical connector slot 1131, seventh mechanical connector slot 1132, and eighth mechanical connector slot 1133.

In a preferred embodiment, fifth cleat 1188 is inserted directly into fifth hole 1140. Additionally, sixth cleat 1190 is preferably inserted directly into sixth hole 1142. Seventh cleat 1192 is preferably inserted directly into seventh hole 1144.

In this manner, first cleat 1180, second cleat 1182, third cleat 1184, fourth cleat 1186, fifth cleat 1188, sixth cleat 1190 and seventh cleat 1192 are all fastened to outsole 1102.

Figure 15:
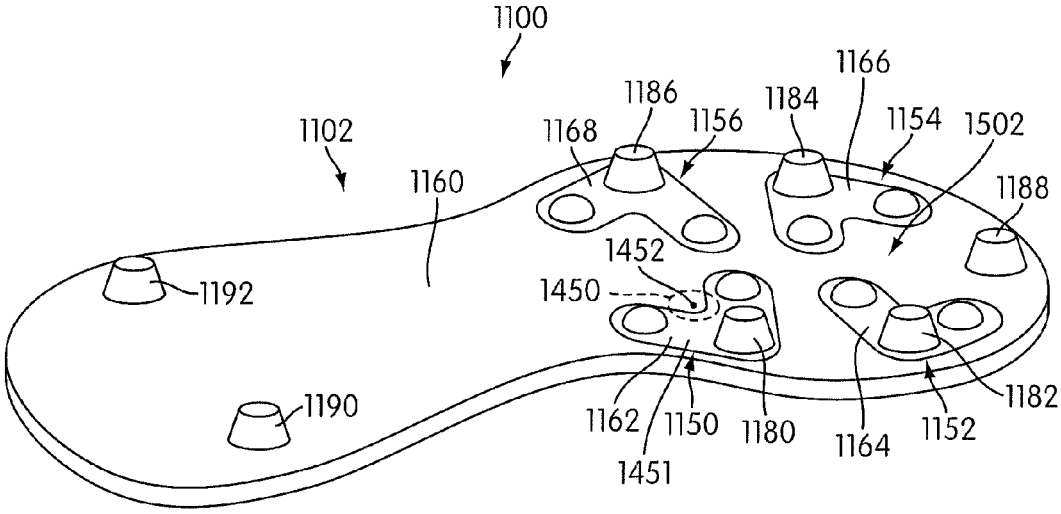
FIG. 15 is an assembled isometric view of a preferred embodiment of an interchangeable pod system.

FIG. 15 is an isometric view of a preferred embodiment of interchangeable pod system 1100, after first pod 1150, second pod 1152, third pod 1154, and fourth pod 1156 have all been fastened to outsole by means of first cleat 1180, second cleat 1182, third cleat 1184, and fourth cleat 1186. Fifth cleat 1188, sixth cleat 1190, and seventh cleat 1192 are also fastened directly to outsole 1102. In this embodiment, first pod outer face 1162, second pod outer face 1164, third pod outer face 1166, and fourth pod outer face 1168 are flush with outsole outer face 1160. In some embodiments, first pod outer face 1162, second pod outer face 1164, third pod outer face 1166, and fourth pod outer face 1166 may not be flush with outsole outer face 1160.

Additionally, first pod 1150, second pod 1152, third pod 1154, and fourth pod 1156 will not turn in place because they are non-circular in shape and they are disposed in first mounting region 1106, second mounting region 1108, third mounting region 1110, and fourth mounting region 1112, which are also non-circular in shape.

Preferably, first pod 1150 includes first central portion 1450 and first peripheral portion 1451. In particular, first central portion 1450 may be associated with, and include, first centroid 1452 of first pod 126. In this embodiment, because of the asymmetric shape of first pod 1150, centroid 1452 is not disposed on first pod 1150. In a preferred embodiment, first cleat 1180 may be disposed in first peripheral portion 1451. Preferably, pods 1152, 1154 and 1156 are similar to first pod 1150 in this manner.

FIG. 15 also includes tread configuration 1502, which is a collection of the tread elements from first pod 1150, second pod 1152, third pod 1154, and fourth pod 1156.

Figure 16:
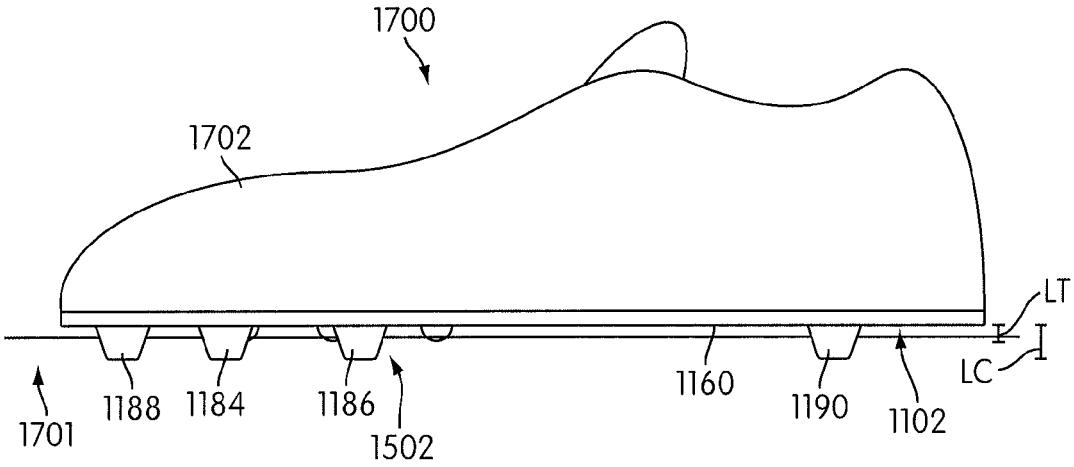
FIG. 16 is a side view of a preferred embodiment of an article of footwear.

FIG. 16 shows a side view of a preferred embodiment of an article of footwear 1700 in contact with surface 1701. Article of footwear 1700 includes footwear upper 1702. Footwear upper 1702 may be constructed of any material. In some embodiments, footwear upper 1702 may be constructed of leather and/or a synthetic material. In some embodiments, footwear upper 1702 will be composed of many different materials. Article of footwear 1700 further includes outsole 1702. Outsole 1102 preferably includes third cleat 1184, fourth cleat 1186, fifth cleat 1188, and sixth cleat 1190. First cleat, second cleat, and seventh cleat are also attached to outsole 1102, though they are not seen in FIG. 16. Article of footwear 1700 also includes tread configuration 1502, as well as other tread elements.

As measured from outer surface 1160 of outsole 1102, the cleats are seen to extend further than any of the tread elements of tread configuration 1502. The tread elements extend a distance LT, the length of the tread elements, from outer surface 1160 of outsole 1102. Each cleat extends a distance LC, the length of the cleats, from outer surface 1160 of outsole 1102. LC is seen to be greater than LT in FIG. 16.

As seen in FIG. 16, first tread configuration 1502 may penetrate slightly into surface 1701. Preferably, third cleat 1184, fourth cleat 1186, fifth cleat 1188, and sixth cleat 1190 have penetrated further into surface 1701 than first tread configuration 1502. The first cleat, second cleat, and seventh cleats may also penetrate into surface 1701. Surface 1701 may be any type of surface, including, but not limited to, grass, Astroturf®, or any surface that is porous enough for a cleat to penetrate into the surface. In this way, traction is applied between article of footwear 1700 and surface 1701 through both cleats and tread elements.

Though articles of footwear are often expensive, the pod sets and cleat sets can be significantly cheaper. Therefore the intended user need only purchase one article of footwear, and can purchase many different pod sets and cleat sets. This allows the user a wide range of variations in traction for the article of footwear by the modification of the outsole. Additionally, since changing from one cleat set and pod set to another is easy, the user can make these modifications at the time of use. If rain develops just before a game begins, the user of the interchangeable pod system can easily make adjustments to their article of footwear in an attempt to provide the most effective type of traction for this situation.

Figure 17:
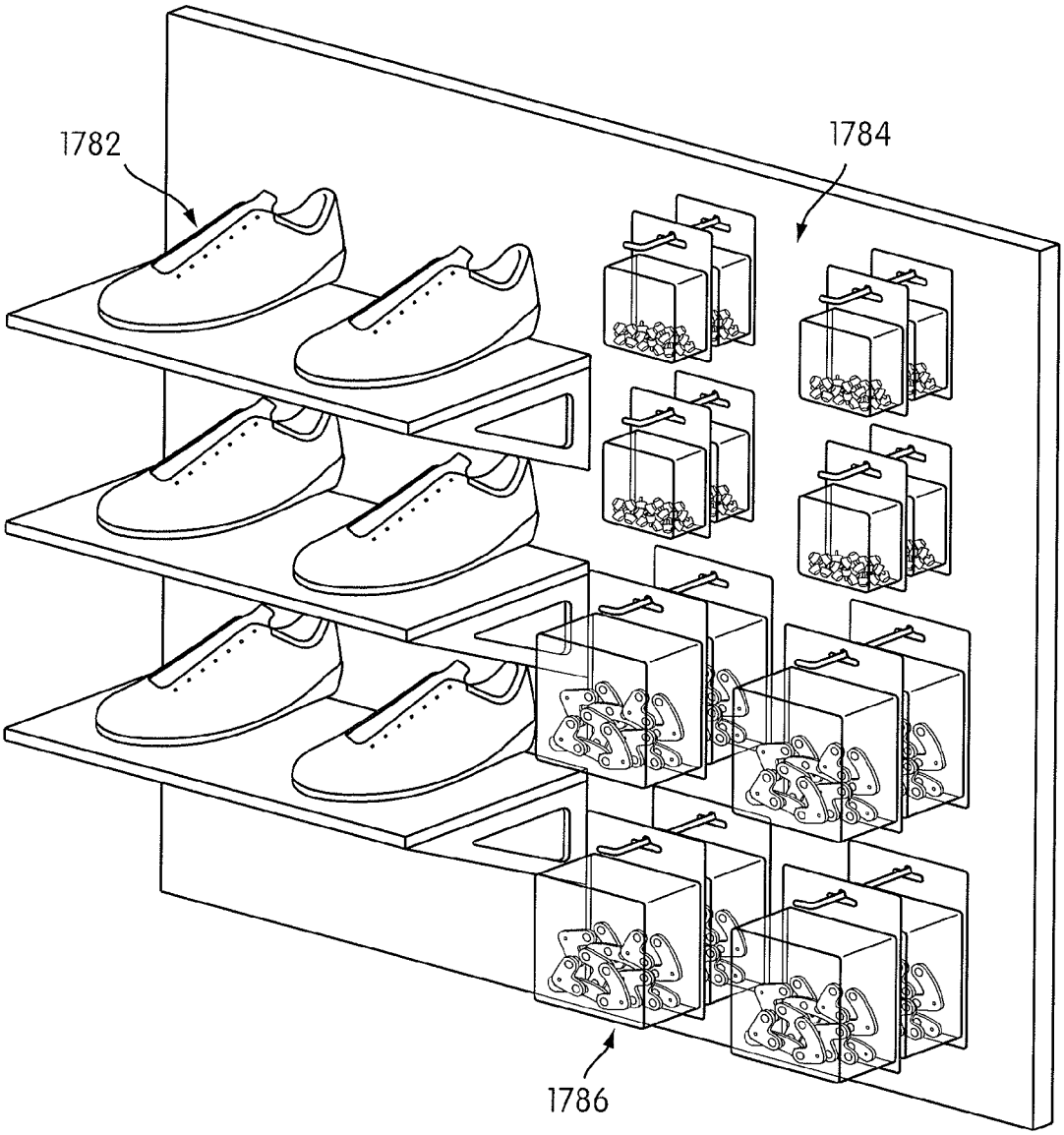
FIG. 17 is an isometric view of a preferred embodiment of a retail system.

FIG. 17 shows a preferred embodiment of a retail system, in which articles of footwear 1782 are sold simultaneously with pre-packaged cleat sets 1784 and pre-packaged pod sets 1786. In this embodiment, the retail system is a section of a wall. Preferably, this wall would be a portion of a retail store. Articles of footwear 1782 are shown generically in FIG. 17 only for the purpose of illustration. In some embodiments, these articles of footwear comprise different styles and colors.

Using a retail system, a user could purchase a member of articles of footwear 1782, three different members of pre-packaged cleat sets 1784, and three different members of pre-packaged pod sets 1786. This would give them nine different variations in the type of traction that could be accomplished through the modification of the article of outsole. Additionally, the pre-packaged cleat sets 1784 and the pre-packaged pod sets 1786 are easily portable in the sense that they are small compared to the size articles of footwear 1782, which are already transported by the user. This feature allows the user to modify the outsole of the article of footwear at any time.

Knowing the surface on which footwear will be used is of primary importance in determining the type of cleats and tread elements to be used. In addition to knowing the type of surface, it may be important to know the conditions of the surface as well. In this way, an article of footwear may be designed to maximize performance for a specific type of surface and a specific set of surface conditions. Different surfaces may require the use of different types of cleats and tread elements. Likewise, different surface conditions may require the use of different types of cleats and tread elements. In many cases, in order to ensure maximum performance in a variety of conditions, the user must purchase several different types of footwear. Often, footwear is expensive. Using an interchangeable pod system, the user may purchase just one article of footwear, and purchase separate pods and cleats. This allows the user to easily interchange the tread configuration and types of cleats to be used in order to maximize performance in a given setting.

Figure 18:
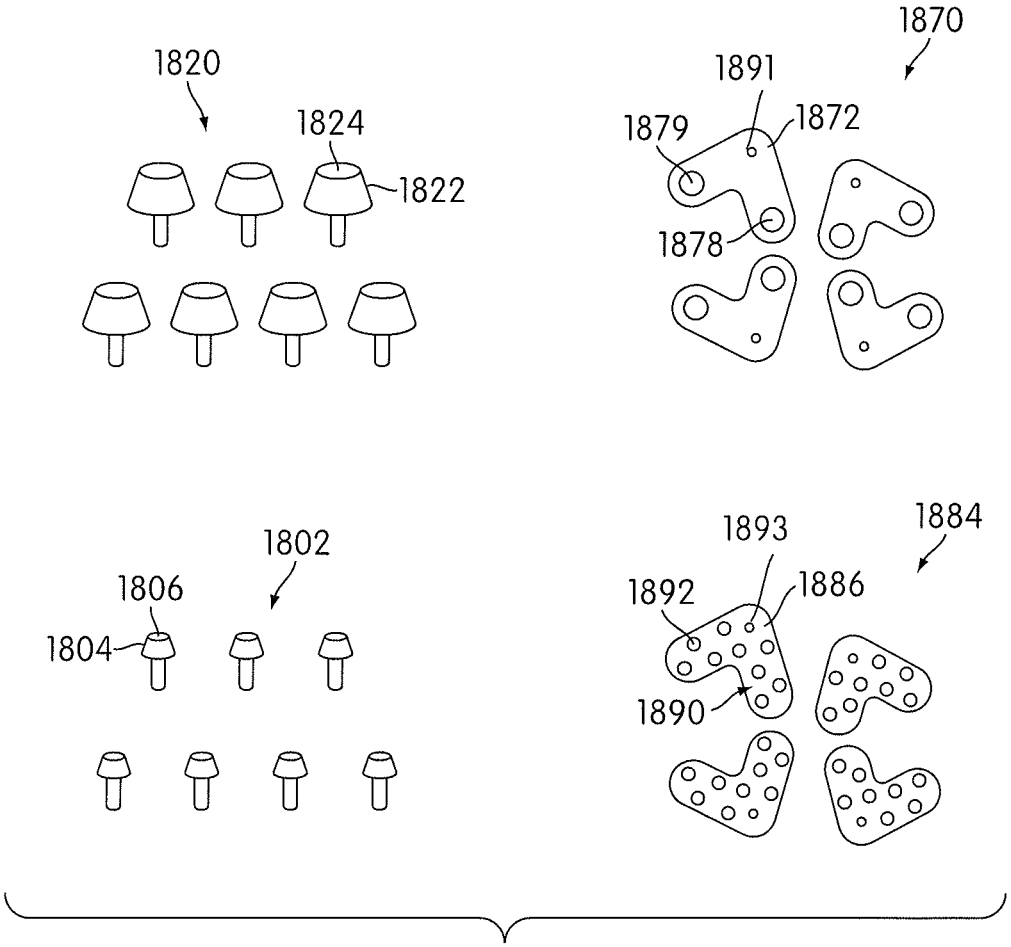
FIG. 18 is a schematic view of a preferred embodiment of several cleat sets and several pod sets.

FIG. 18 is a preferred embodiment of a plurality of cleat sets and several pod sets. Depending on the type of surface, and the surface conditions, different cleat sets and pods sets may be attached to an outsole.

First cleat set 1802 and second cleat set 1820, are two distinct types of cleat sets. As seen here, each of the cleats are different sizes. First cleat set 1802 includes first cleat 1804. First cleat 1804 includes first cleat head 1806. The remaining six cleats in first cleat set 1802 are preferably identical to first cleat 1804 in all respects. Second cleat set 1820 includes second cleat 1822. Second cleat 1822 includes second cleat head 1824. Preferably, second cleat head 1824 is longer than first cleat head 1806. The remaining six cleats in second cleat set 1820 are preferably identical to second cleat 1822 in all respects.

In addition to differences in the size of the cleat heads, each cleat set may also differ in material composition. In general, any two cleat sets may be considered as distinct, and therefore potentially useful for different surfaces and or surface conditions, if they are different in any way. These differences may include size and material composition.

In general, small cleats, like first cleat set 1802, are often used most often on artificial surfaces, such as Astroturf®. Larger cleats, like third cleat set 1820, are often most useful on high grass. In some embodiments, first cleat set 1802 and second cleat set 1820 may be used on different surfaces than artificial surfaces.

Although only three distinct cleat sets are shown here, an interchangeable pod system may include any number of distinct cleat sets. And though each cleat set may be designed with a specific surface and set of surface conditions in mind, the cleat sets need not be used for the surfaces and surface conditions for which they were designed.

Also seen in FIG. 18 are embodiments of several pod sets. In these embodiments, each pod set consists of four identical pods. Additionally, each pod set consists of different tread configurations that, like the various types of cleats, are each suited to a specific kind of surface and/or surface condition.

On artificial surfaces with dry surface conditions, tread configurations may include some tread elements which are hemispheric in shape and that have wide spacing between them. First pod set 1870 is representative of a pod with a tread configuration configured for artificial surfaces conditions. First pod set 1870 includes first pod 1872. First pod 1872 preferably includes first tread element 1878. In this embodiment, first tread element 1878 is a hemispheric dome. In particular, first tread element 1878 is a raised portion of second forefoot pod 1872. First pod 1872 also preferably includes second tread element 1879. Second tread element 1879 may be identical to first tread element 1878, or it may be distinct in size, shape, or material composition. First pod 1872 also includes through-hole 1891. First pod set 1870 further includes three additional pods. In a preferred embodiment, the remaining three pods may be substantially identical to first pod 1870.

For a grassy surface with wet conditions, a tread configuration may be designed with small hemispheric tread elements that have a narrow spacing between them. Second pod set 1884 is representative of a set of pods with tread configurations that are configured for wet grass. Second pod set 1884 includes second pod 1886. Second pod 1886 includes tread configuration 1890. Tread configuration 1890 includes second tread element 1892. In this embodiment, second tread element 1892 is a hemispheric dome. In particular, second tread element 1892 is a raised portion of second pod 1886. Tread configuration 1890 includes many other tread elements, which may be identical to second tread element 1892. Second pod 1886 also includes through-hole 1893. In a preferred embodiment, the remaining pods comprising second pod set 1884 may be substantially identical to second pod 1886.

Although two distinct cleats sets and two pod sets are seen in FIG. 18, in some embodiments there could be any number of distinct cleat sets and distinct pod sets.

Figure 19:
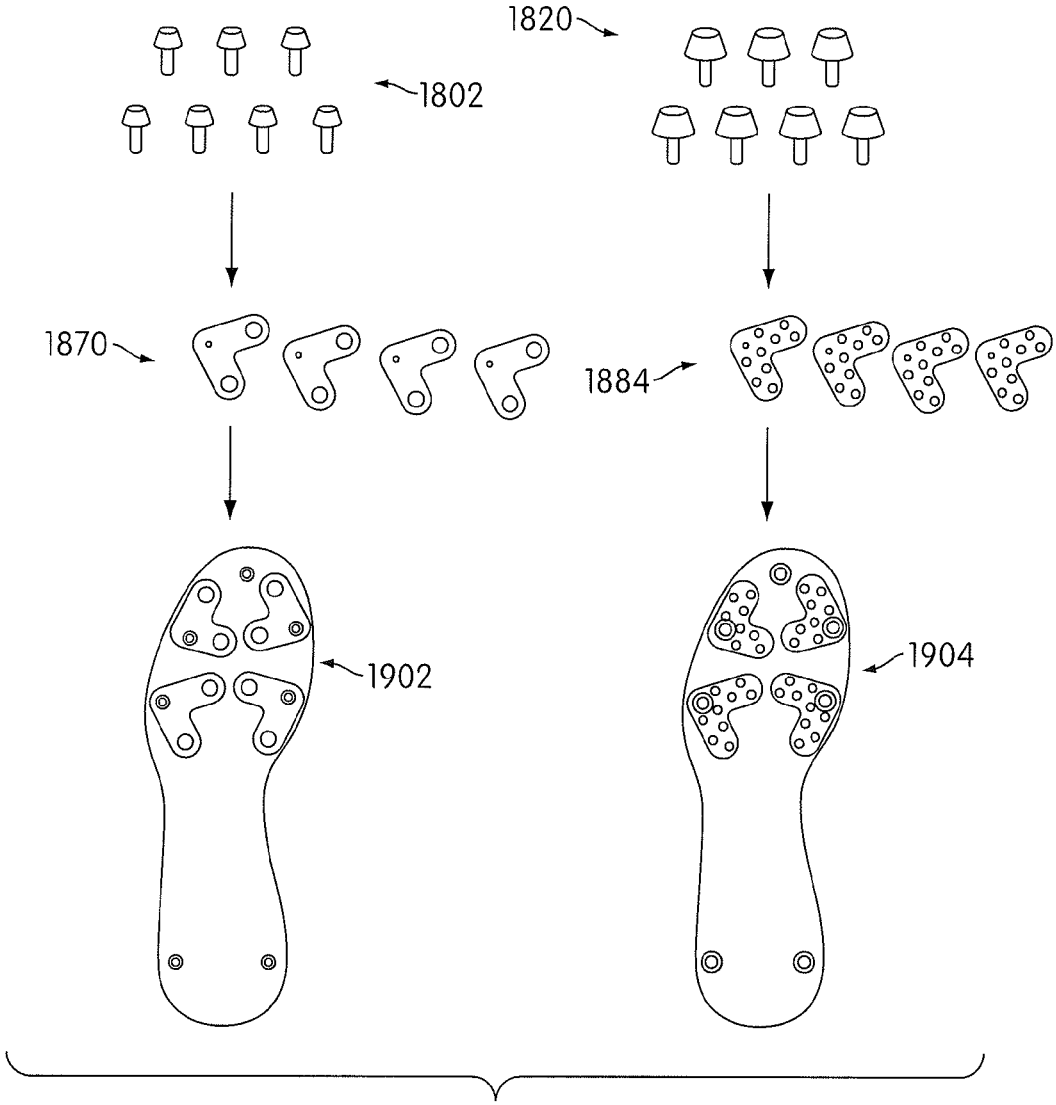
FIG. 19 is a schematic view of a preferred embodiment of several possible configurations for an interchangeable pod system.

FIG. 19 is a schematic diagram of a preferred embodiment of two different configurations of an article of footwear using an interchangeable pod system. In a first configuration first cleat set 1802 is combined with first pod set 1870. First cleat set 1802, as previously discussed, may be used on artificial surfaces. Likewise, first pod set 1870 may also be used on artificial surfaces, and in particular in dry surface conditions. The final product is shown as first modified outsole 1902. First modified outsole 1902 is configured so that the article of footwear is most effective on artificial surfaces with dry surface conditions.

In a second configuration, second cleat set 1820 is combined with second pod set 1884. Second cleat set 1820 may be used on grass in wet conditions. Likewise, second pod set 1870 may be used on grass in wet conditions. The final product is shown as second modified outsole 1904. Second modified outsole 1904 is configured so that the article of footwear is most effective in wet grass In the previous embodiments, a small cleat set was combined with a pod set that included a light tread configuration. Likewise, a long cleat set was combined with a pod set that included an aggressive tread configuration. In some situations, however, it may be beneficial to use a short cleat set with a pod set that includes aggressive tread configuration.

Figure 20:
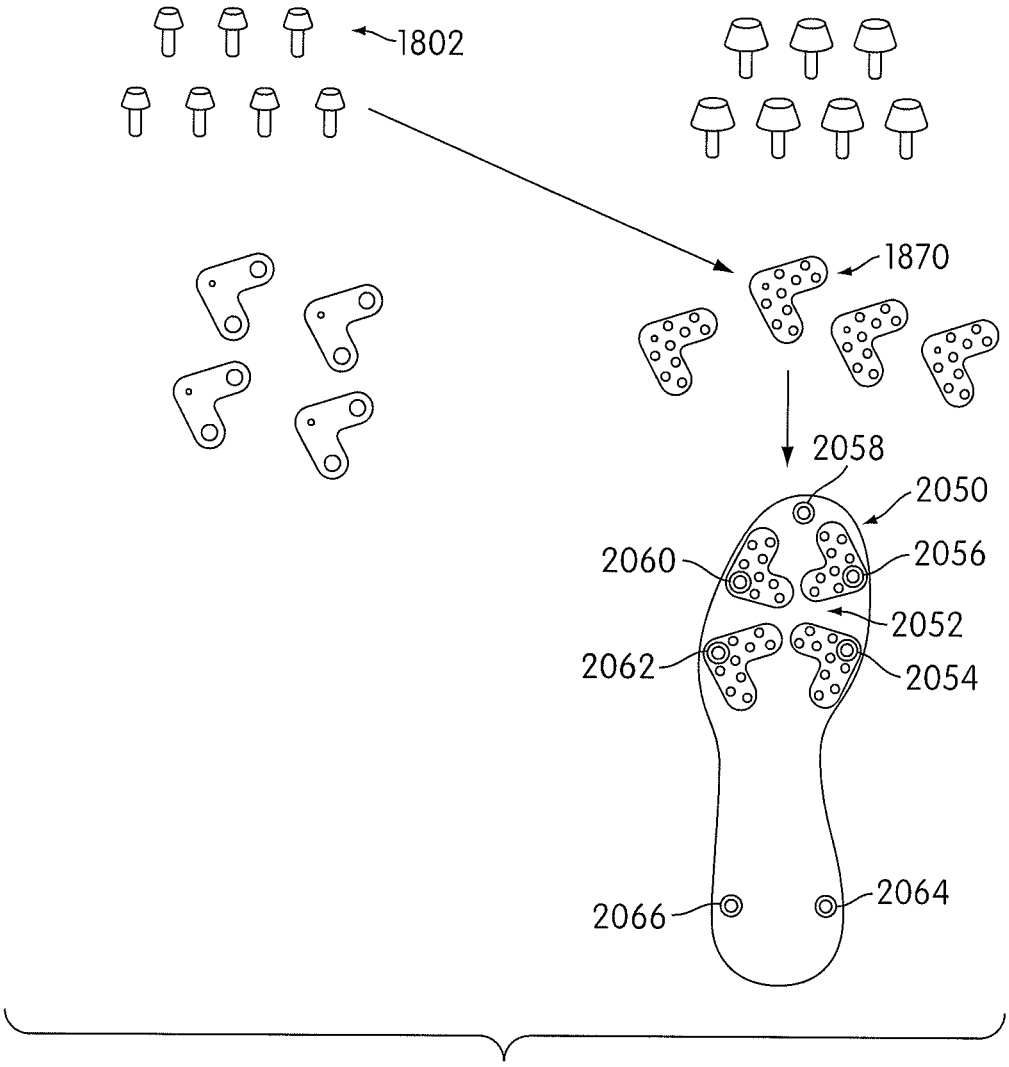
FIG. 20 is a schematic view of a preferred embodiment of a possible configuration of an interchangeable pod system.

FIG. 20 is a schematic representation of a preferred embodiment of first cleat set 1802 being combined with second pod set 1870 to form modified outsole 2050. Modified outsole 2050 includes a tread configuration 2052 that may be useful in wet surface conditions. Modified outsole 2050 further includes first cleat 2054, second cleat 2056, third cleat 2058, fourth cleat 2060, fifth cleat 2062, sixth cleat 2064, and seventh cleat 2066 that are all configured for artificial surfaces.

In the embodiments shown so far, two types of cleats have been shown, along with two types of pods. The number of distinct combinations using two cleat sets and two pods set is 4.

Figure 21:
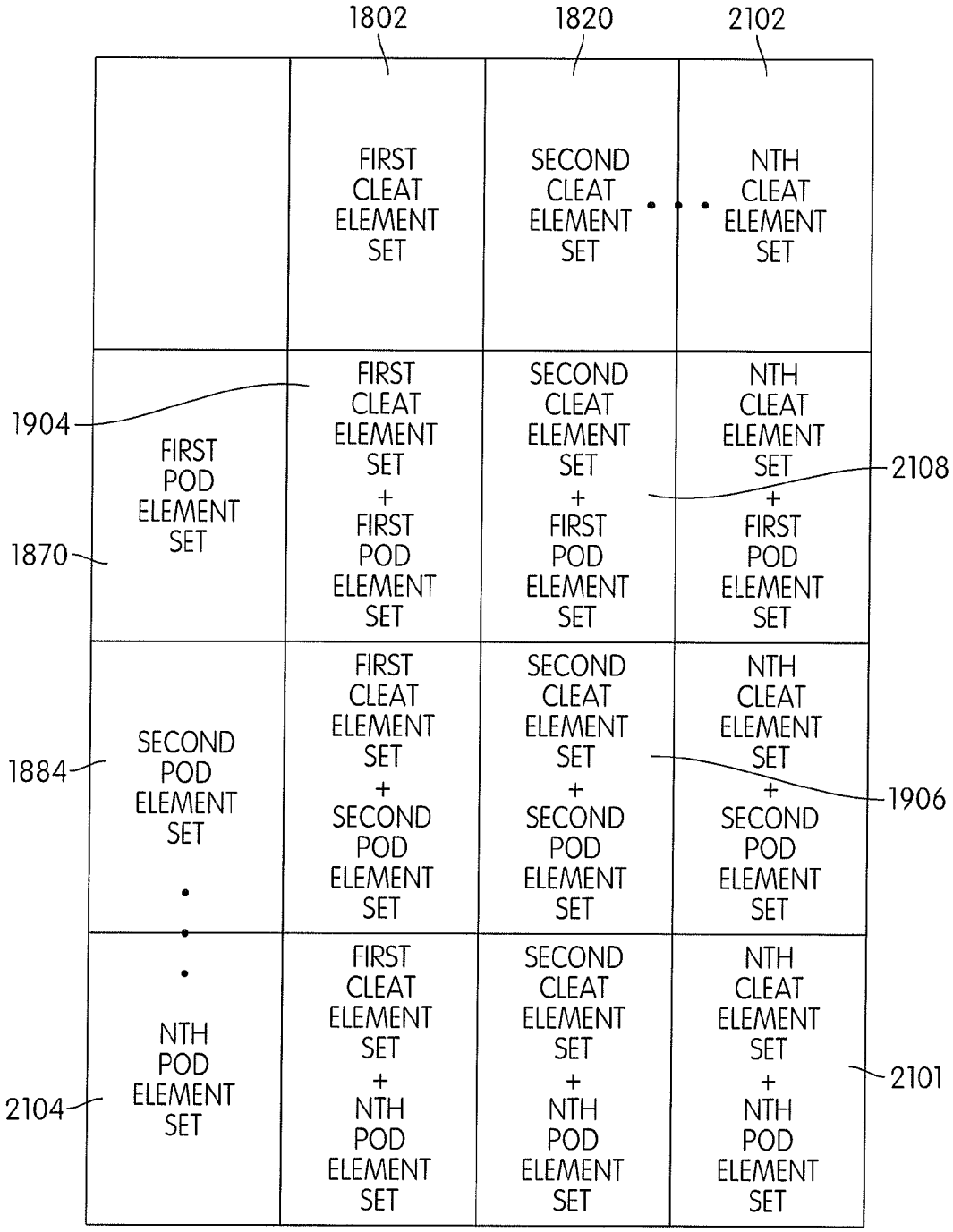
FIG. 21 is schematic view of a preferred embodiment of possible configurations using an interchangeable pod system.

FIG. 21 is a schematic representation of a preferred embodiment of the various combinations of cleat sets with pod sets. At the top of the second column is first cleat set 1802. At the top of the third column is second cleat set 1820. In addition to these two cleat sets, multiple cleat sets could be included. Here, nth cleat set 2102 is shown to illustrate that there may be many different cleat sets, up to n different types.

At the beginning of the second row in FIG. 21 is first pod set 1870. At the beginning of the second row is second pod set 1884. In addition to these two pod sets, multiple pod sets may be included. Here, nth pod set 2104 is shown to illustrate that there may be many different pod sets, up to n different types.

Every possible combination of cleat sets and pod sets is shown in FIG. 21. Each combination represents a distinct modified outsole. First modified outsole 1904 is seen under first cleat set 1802 and across from first pod set 1870. Second modified outsole 1906 is seen under second cleat set 1820 and across from second pod set 1884. Also shown is modified outsole 2101, which under nth cleat set 2102 and across from nth pod set 2104. In addition to these combinations of cleat sets and pod sets that have already been described, it is also possible to form other combinations. Modified outsole 2108 is seen in FIG. 21 to be a combination of second cleat set 1820 and first pod set 1870.

If there are four distinct cleat sets and four distinct pod sets, then there are sixteen distinct modified outsoles that can be formed. For five distinct cleat sets and five distinct pod sets there are twenty-five distinct modified outsoles that can be formed. Therefore, as the number of distinct cleat sets and the number of distinct pod sets increases, the total number of possible modified outsoles also increases. A larger group of possible modified outsoles allows the user of an article of footwear to make more subtle adjustments that may increase performance for a given surface with a given set of surface conditions.

The previous embodiments discuss a group of pod sets that are generally manufactured in a single size. In some embodiments, it may be preferable to manufacture several sizes of the pod sets. Each of the different sizes may be preconfigured for a particular outsole/footwear size. In a preferred embodiment, each of the sizes associated with various pod sets may be configured for a range of outsole/footwear sizes.

Figure 22:
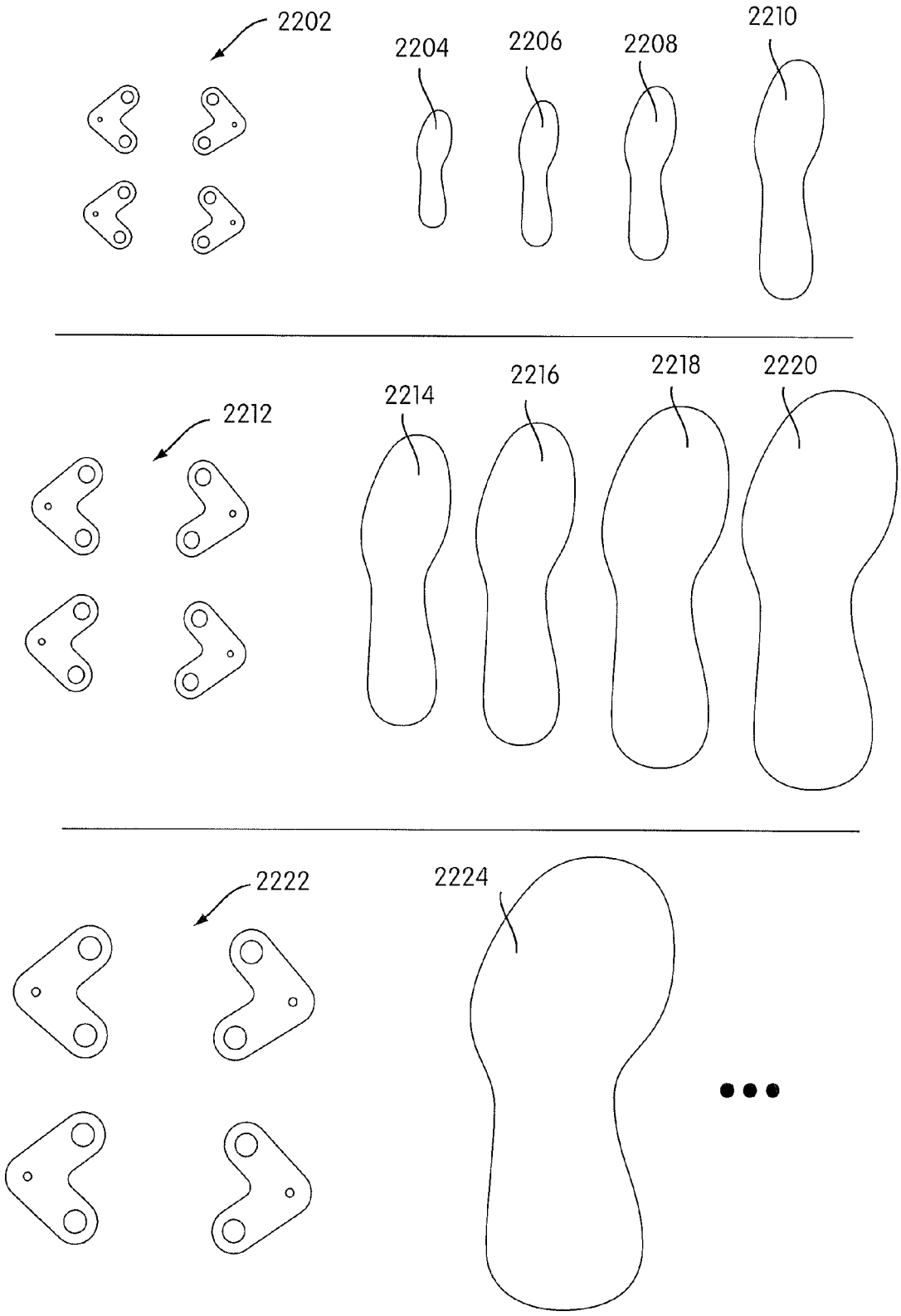
FIG. 22 is a schematic view of different sized pod sets.

Referring to FIG. 22, small pods 2202 are preferably associated with various sizes of footwear. In some embodiments, small pods 2202 may be associated with first size 2204, second size 2206, third size 2208, and fourth size 2210. In a preferred embodiment, first size 2204 may be a size four article of footwear. Likewise, second size 2206 may be a size five article of footwear. In a similar manner, third size 2208 may be a size six article of footwear. Finally, fourth size 2210 may be a size seven article of footwear.

Preferably, medium pods 2212 may be associated with fifth size 2214, sixth size 2216, seventh size 2218 and eighth size 2220. In a preferred embodiment, sizes 2214, 2216, 2218 and 2220 may be associated with articles of footwear of sizes 8-11, respectively. In some embodiments, large pods 2222 may be associated with ninth size 2224 as well as any other size that is larger than ninth size 2224. In a preferred embodiment, ninth size 2224 may be a size 12 article of footwear.

The various sizes of pods discussed here are only meant to be illustrative. In some embodiments, more variations may be used in the pod sizes. In some embodiments, each footwear size may be associated with a corresponding pod size. In other embodiments, two pod sizes may be used, for example.

In the previous embodiments, each pod was flat and confined to the underside of an outsole. In some embodiments, it may be preferable to have pods that cover some portions of the edges of the outsole. In a preferred embodiment, a substantial majority of the outer periphery of the outsole may be covered by the pods.

Figure 23:
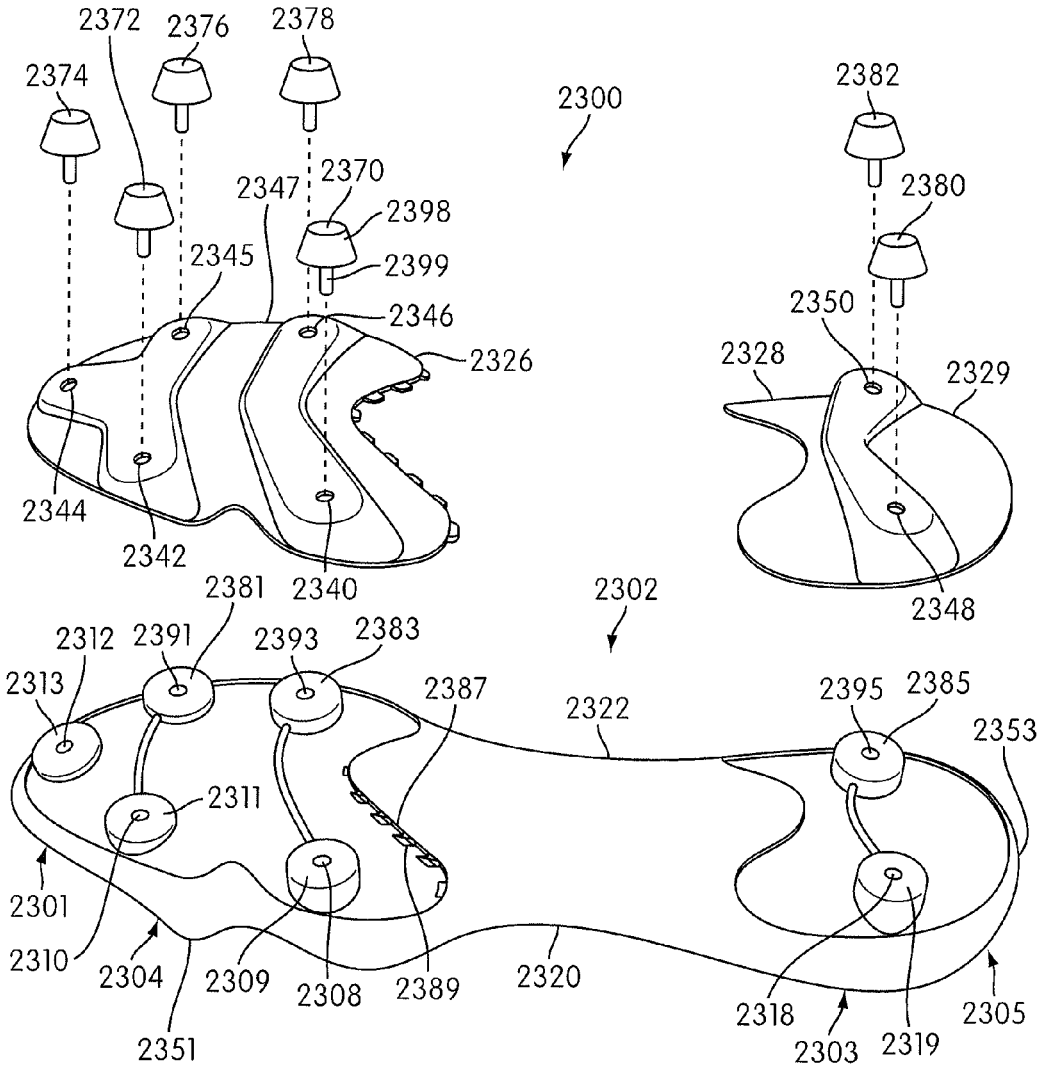
FIG. 23 is an exploded isometric view of a preferred embodiment of an interchangeable pod system.

FIG. 23 is an isometric view of a preferred embodiment of interchangeable pod system 2300. Outsole 2302 is usually integrated into an article of footwear. Outsole 2302 need not be detachable from an article of footwear. Here, outsole 2302 is shown in isolation in order to emphasize the preferred components of interchangeable pod system 2300. Outsole 2302 may be composed of any material. Outsole 2302 can also be any shape, including various thicknesses and styles.

For clarity, the following detailed description discusses a preferred embodiment of pod system 2300 including two pods. However, in other embodiments, the number of pods may be different. In some embodiments, only one pod may be used, in the forefoot region, for example. In other embodiments, multiple pods may be used.

Preferably, outsole 2302 includes a first portion 2304 and a second portion 2305. In some embodiments, first portion 2304 may correspond to the forefoot outsole 2302. In some embodiments, second portion 2305 may correspond to the heel portion of outsole 2302. In particular, first portion 2304 preferably includes first hole 2308, second hole 2310, third hole 2312, fourth hole 2391 and fifth hole 2393. First hole 2308 and second hole 2310 are preferably disposed along medial side 2320 of outsole 2302. Fourth hole 2391 and fifth hole 2393 are preferably disposed along lateral side 2322 of outsole 2302. Third hole 2312 is preferably disposed between second hole 2310 and fourth hole 2391. Likewise, second portion 2305 includes a sixth hole 2318, disposed along medial side 2320 of outsole 2302. Second portion 2305 also includes seventh hole 2395, disposed along lateral side 2322 of outsole 2302.

First hole 2308 is preferably disposed along first raised mound 2309. First raised mound 2309 is a cylindrical like extension of outsole 2302. In a similar manner, second hole 2310 is preferably disposed along second raised mound 2311. In a similar manner, third hole 2312 is preferably disposed along third raised mound 2313. In a similar manner, fourth hole 2391 is preferably disposed along fourth raised mound 2381. In a similar manner, fifth hole 2393 is preferably disposed along fifth raised mound 2383. In a similar manner, sixth hole 2318 is preferably disposed along sixth raised mound 2319. In a similar manner, seventh hole 2395 is preferably disposed along seventh raised mound 2385. Although this embodiment includes seven holes disposed along seven raised mounds in outsole 2302, other embodiments may include any number of holes and raised mounds. In a preferred embodiment, outsole 2302 includes slots 2387, disposed along the edge of first portion 2304. These slots are preferably configured to receive mechanical connectors, that may be included as part of first pod 2326.

Interchangeable pod system 2300 preferably includes first pod 2326 and second pod 2328. In some embodiments, first pod 2326 may correspond to the forefoot portion of the outsole, while second pod 2328 may correspond to the heel portion of the outsole. In some embodiments, first pod 2326 and second pod 2328 may be constructed a rubber material or a synthetic plastic. In some embodiments, first pod 2326 and second pod 2328 may be constructed of different materials from rubber or plastic. In some embodiments, first pod 2326 and second pod 2328 may be constructed of the same material. In other embodiments, first pod 2326 and second pod 2328 may be constructed of different materials.

In a preferred embodiment, first portion 2304 includes first base portion 2301 and first curved periphery 2351. First curved periphery 2351 is preferably disposed at an angle to first base portion 2301. Second portion 2305 preferably includes second base portion 2303 and second curved periphery 2353. Second curved periphery 2353 is preferably disposed at an angle to second base portion 2303.

In a preferred embodiment, first pod 2326 is preferably configured to wrap around the entirety of first base portion 2301. First pod 2326 also preferably covers a substantial majority of first curved periphery 2351. In a similar manner, second pod 2328 is preferably configured to wrap around the entirety of second base portion 2303. Second pod 2328 also preferably covers a substantial majority of second curved periphery 2351. With this configuration, first pod 2326 and second pod 2328 may help apply additional traction to the outer periphery of outsole 2302. Additionally, the outer periphery of outsole 2302 may be protected, as pods are more easily replaced than outsoles.

Generally, first pod 2326 and second pod 2328 may include provisions for receiving cleats. In some embodiments, first pod 2326 preferably includes first through-hole 2340, second through-hole 2342, third through-hole 2344, fourth through-hole 2345, and fifth through-hole 2346. Preferably, first through-hole 2340, second through-hole 2342, third through-hole 2344, fourth through-hole 2345, and fifth through-hole 2346 are disposed along the outer edge of first pod 2326 so as to be in alignment with first hole 2308, second hole 2310, third hole 2312, fourth hole 2391, and fifth hole 2393 respectively. In particular, first through-hole 2340, second through-hole 2342, third through-hole 2344, fourth through-hole 2345, and the fifth through-hole 2346 are constructed in such a way that a small fastener could be inserted through each through-hole.

In some embodiments, second pod 2328 preferably includes sixth through-hole 2348 and seventh through-hole 2350. Preferably, sixth through-hole 2348 and seventh through-hole 2350 are disposed along the outer edge 2329 of second pod 2328 so as to be in alignment with sixth hole 2318 and a seventh hole 2395, respectively. In particular, sixth through-hole 2348 and seventh through-hole 2350 are constructed in such a way that a small fastener could be inserted through second pod 2328. In general, the number of through-holes included in each pod may be varied, so long as each pod contains at least two through-holes.

Interchangeable pod system 2300 preferably includes first cleat 2370, second cleat 2372, third cleat 2374, fourth cleat 2376, fifth cleat 2378, sixth cleat 2380, and seventh cleat 2382. First cleat 2370 also includes cleat head element 2398 and cleat fastener 2399. In general, the number of cleats included in interchangeable pod system 2300 can be different than seven. Some embodiments may include less than seven cleats, while other embodiments may include more than seven cleats. In a preferred embodiment, the number of total cleats is at least twice the number of total pods.

Figure 24:
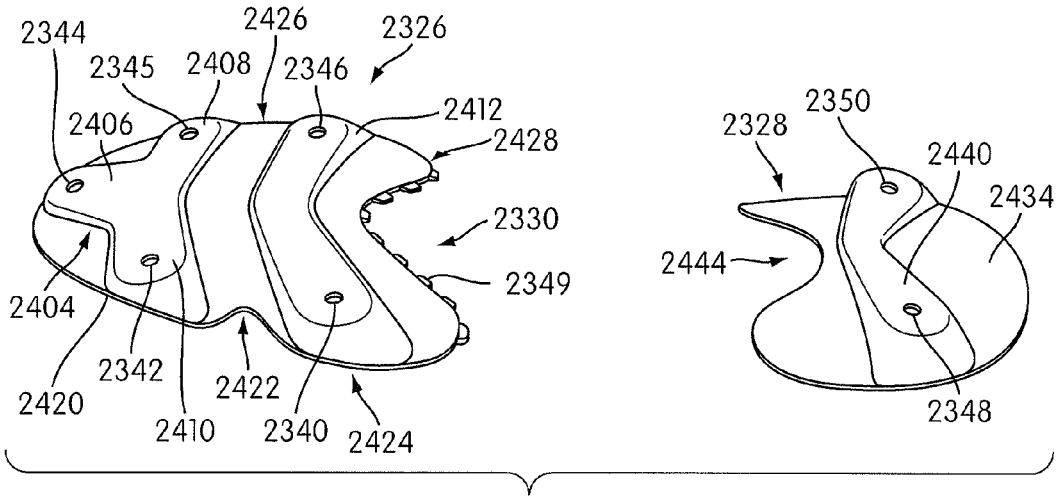
FIG. 24 is an isometric view of a preferred embodiment of a first pod and a second pod.

FIG. 24 is an isolated isometric view of a preferred embodiment of first pod 2326 and second pod 2328. As seen in FIG. 24, first pod 2326 includes first ridge 2404. First ridge 2404 includes first flange 2406, second flange 2408, and third flange 2410. Forefoot pod also preferably includes second ridge 2412. First through-hole 2340 and fifth through-hole 2346 are preferably disposed along second ridge 2412. Second through-hole 2342, third through-hole 2344, and fourth through-hole 2345 are preferably disposed along first ridge 2404.

In some embodiments, first pod 2326 preferably includes first curved portion 2420. Additionally, first pod 2326 preferably includes first indented portion 2422 along lateral side 2424 of first pod 2326. First indented portion 2422 is preferably disposed between first ridge 2404 and second ridge 2412. First pod 2326 also preferably includes second indented portion 2426 along medial side 2428 of first pod 2326. Second indented portion 2426 is preferably disposed between first ridge 2404 and second ridge 2412.

In some embodiments, first pod 2326 preferably includes rear indented region 2330. Rear indented region 2330 preferably includes mechanical connectors 2349. Mechanical connectors 2349 are preferably configured to fit with slots 2387 disposed along outsole 2302.

In some embodiments, second pod 2328 preferably includes second curved portion 2434. Additionally, second pod 2328 preferably includes third ridge 2440. Preferably, sixth through-hole 2348 and seventh through-hole 2350 are disposed along third ridge 2440. Second pod 2328 preferably includes indented region 2444.

Figure 25:
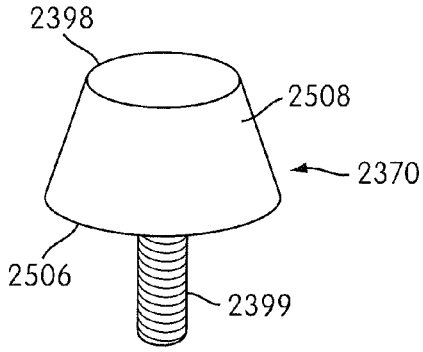
FIG. 25 is an isometric view of a preferred embodiment of a cleat.

FIG. 25 is an isolated view of a preferred embodiment of first cleat 2370. Preferably, first cleat 2370 includes cleat head 2398, as well as cleat fastener 2399. Cleat head 2398 may be constructed of a variety of materials, including, but not limited to, rubber, hard plastic, or metal. Preferably, cleat head 2398 is widest at cleat base 2506 and narrowest at cleat tip 2508. This allows first cleat 2370 to efficiently penetrate into surfaces during use. Cleat fastener 2399 is preferably made of a durable material that will not break during periods where cleat 2370 is engaged with a surface. In particular, cleat fastener 2399 may be threaded in some embodiments, like a screw, or include some portion that is threaded. This feature allows for first cleat 2370 to be fastened to outsole 2302. In some embodiments, cleat fastener 2399 may include another mechanism by which cleat 2370 may be fastened into outsole 2302.

All aspects of first cleat 2370 described here preferably apply to second cleat 2372, third cleat 2374, fourth cleat 2376, fifth cleat 2378, sixth cleat 2380, and seventh cleat 2382 as well. In other words, each of the cleats 2372, 2374, 2376, 2378, 2380 and 2382 are preferably substantially identical to first cleat 2370.

Referring to FIG. 23, first cleat 2370 is designed to insert through first through-hole 2340 and engage first hole 2308. In particular, cleat fastener 2399 extends through first through-hole 2340 and engages first hole 2308. In some embodiments, first hole 2308 may include threading that engages with threading in cleat fastener 2399, so that first cleat 2370 may be screwed into outsole 2302. In some embodiments, there may be other mechanisms by which cleat fastener 2399 engages with first hole 2308 to attach first cleat 2370 to outsole 2302. Preferably, first through-hole 2340 is just large enough so that cleat fastener 2399 can be inserted, but small enough so that cleat head 2398 can not be inserted through first through-hole 2340. As first cleat 2370 is fastened to outsole 2302, cleat head 2398 imposes a force on first pod outer face 2332. The compressive force applied to first pod outer face 2332 by cleat head 2398 secures a portion of first pod 2326 in place.

As with first cleat 2370, each of the remaining cleats preferably include a cleat fastener and a cleat head. This allows the remaining cleats to fasten portions of the pods in place in a manner similar to the way that first cleat 2370 fastened a portion of first pod 2326 into place. In particular, second cleat 2372 is inserted through second through-hole 2342 and engages second hole 2310. In a similar manner, third cleat 2374 is inserted through third through-hole 2344 and engages third hole 2312. In a similar manner, fourth cleat 2376 engages fourth through-hole 2341 and engages fourth hole 2391. In a similar manner, fifth cleat 2378 is inserted through fifth through-hole 2346 and engages fifth hole 2393. In this manner, first cleat 2370, second cleat 2372, third cleat 2374, fourth cleat 2376, and fifth cleat 2378 fix first pod 2326 to outsole 2302.

In a similar manner, sixth cleat 2380 and seventh cleat 2382 are used to fasten second pod 2328 to outsole 2302. In particular, sixth cleat 2380 is inserted through sixth through-hole 2348 and engages a sixth hole 2318. In a similar manner, seventh cleat 2382 is inserted through seventh through-hole 2350 and engages seventh hole 2395.

In some embodiments, a pod system may include additional provisions for attaching the pods to the outsole in addition to the previously discussed cleats. In some embodiments, a pod may include mechanical connectors along a portion of the periphery. In a preferred embodiment, mechanical connectors 2349 of first pod 2326 are configured to insert into slots 2387 of outsole 2302, further securing first pod 2326 in place.

Figure 26:
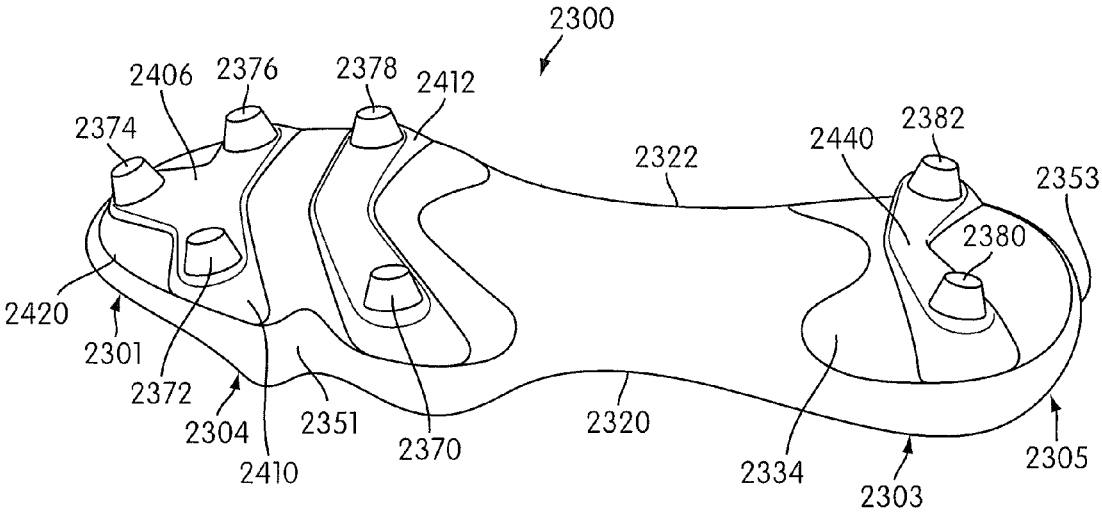
FIG. 26 is an assembled isometric view of a preferred embodiment of an interchangeable pod system.

FIG. 26 is an isometric assembled view of a preferred embodiment of interchangeable pod system 2300, after first pod 2326 and second pod 2328 have been fastened to outsole 2302 by means of first cleat 2370, second cleat 2372, third cleat 2374, fourth cleat 2376, fifth cleat 2378, sixth cleat 2380, and seventh cleat 2382. Using this configuration, both first pod 2326 and second pod 2328 will preferably not turn in place because they have been fastened to outsole 2302 in multiple regions.

In some embodiments, first pod 2326 and second pod 2328 preferably cover the entirety of first base portion 2301 and second base portion 2303 of outsole 2302. Also, first curved periphery 2351 and second curved periphery 2353 have been partially covered by first curved portion 2420 and second curved portion 2434. In a preferred embodiment, a substantial majority of first curved periphery 2351 and second curved periphery 2353 may be covered using this configuration.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A method for assembling an article of footwear comprising:

selecting a pod set from a group of candidate pod sets, wherein each pod set of the group of candidate pod sets includes a forefoot pod and a heel pod, and wherein each pod set of the group of candidate pod sets has a tread configuration different from other pod sets of the group of candidate pod sets;

placing the forefoot pod and the heel pod of the selected pod set in contact with the outsole of the article of footwear;

selecting a cleat set from a group of candidate cleat sets, wherein each cleat set of the group of candidate cleat sets includes at least two cleats, and wherein each cleat set of the group of candidate cleat sets has cleat heads that are at least one of sized differently and shaped differently from cleat heads of other cleat sets of the group of candidate cleat sets;

attaching the forefoot pod of the selected pod set to a forefoot portion of the outsole using a first cleat from the selected cleat set; and attaching the heel pod of the selected pod set to a heel portion of the outsole using a second cleat from the selected cleat set.

2. The method according to claim 1, wherein the selected pod set is a first pod set and the selected cleat set is a first cleat set, and wherein the method further comprises:

removing from the outsole, the first cleat, the second cleat, and the forefoot pod and the heel pod of the first pod set;

selecting a second pod set from the group of candidate pod sets;

placing the forefoot pod and the heel pod of the selected second pod set in contact with the outsole of the article of footwear;

selecting a second cleat set from the group of candidate cleat sets;

attaching the forefoot pod of the selected second pod set to the outsole using a third cleat from the selected second cleat set; and attaching the heel pod of the selected second pod set to the outsole using a fourth cleat from the selected second cleat set.

3. The method according to claim 1, wherein the outsole defines a forefoot mounting region in the forefoot portion of the outsole and a heel mounting region in the heel portion of the outsole, wherein each forefoot pod of each pod set of the group of candidate pod sets has a uniform size and shape that matches the forefoot mounting region, and wherein each heel pod of each pod set of the group of candidate pod sets has a uniform size and shape that matches the heel mounting region.

4. The method according to claim 3, wherein the forefoot mounting region comprises a first recessed region in the forefoot portion of the outsole of the article of footwear and the heel mounting region comprises a second recessed region in the heel portion of the outsole of the article of footwear.

5. The method according to claim 1, wherein each pod of the group of candidate pod sets has a uniformly sized and shaped outer perimeter.

6. The method according to claim 5, wherein the uniformly sized and shaped outer perimeter comprises a V-shape.

7. The method of according claim 5, wherein the outsole defines recessed mounting regions each having an inner perimeter matching the uniformly sized and shaped outer perimeter of the each pod of the group of candidate pod sets.

8. The method according to claim 1, further comprising purchasing the article of footwear, the group of candidate pod sets, and the group of candidate cleat sets from a retailer, wherein the retailer simultaneously offers a plurality of articles of footwear, a plurality of pod sets compatible with the plurality of articles of footwear, and a plurality of cleat sets compatible with the plurality of pod sets and the plurality of articles of footwear, wherein the article of footwear is one of the plurality of articles of footwear, wherein the group of candidate pod sets is a subset of the plurality of pod sets, and wherein the group of candidate cleat sets is a subset of the plurality of candidate cleat sets.

9. The method according to claim 8, wherein the retailer is a retail store.

10. The method according to claim 8, wherein each of the plurality of pod sets is a pre-packaged pod set and each of the plurality of cleat sets is a pre-packaged cleat set.

11. The method according to claim 8, wherein each pod set of the plurality of pod sets is configured for a particular range of footwear sizes of the plurality of articles of footwear, and wherein the plurality of pod sets includes pod sets configured for different ranges of footwear sizes.

12. An interchangeable footwear kit comprising:

an article of footwear having an upper and an outsole;

a group of candidate pod sets, wherein each pod set of the group of candidate pod sets includes a forefoot pod and a heel pod, and wherein each pod set of the group of candidate pod sets has a tread configuration different from other pod sets of the group of candidate pod sets; and a group of candidate cleat sets, wherein each cleat set of the group of candidate cleat sets includes at least a first cleat and a second cleat, and wherein each cleat set of the group of candidate cleat sets has cleat heads that are at least one of sized differently and shaped differently from cleat heads of other cleat sets of the group of candidate cleat sets, wherein the forefoot pod and the heel pod of each pod set contact the outsole of the article of footwear, wherein the first cleat of the each cleat set attaches the forefoot pod of the each pod set to a forefoot portion of the outsole, and wherein the second cleat of the each cleat set attaches the heel pod of the each pod set to a heel portion of the outsole.

13. The interchangeable footwear kit according to claim 12, wherein the forefoot pod and the forefoot portion of the outsole define a first set of aligned holes that receive a fastener portion of the first cleat, and wherein the heel pod and the heel portion of the outsole define a second set of aligned holes that receive a fastener portion of the second cleat.

14. The interchangeable footwear kit according to claim 12, wherein each cleat set of the group of candidate cleat sets has cleat heads that are constructed of a material different from a material of cleat heads of another cleat set of the group of candidate cleat sets.

15. The interchangeable footwear kit according to claim 12, wherein the outsole defines a forefoot mounting region in the forefoot portion of the outsole and a heel mounting region in the heel portion of the outsole, wherein each forefoot pod of each pod set of the group of candidate pod sets has a uniform size and shape that matches the forefoot mounting region, and wherein each heel pod of each pod set of the group of candidate pod sets has a uniform size and shape that matches the heel mounting region.

16. The interchangeable footwear kit according to claim 15, wherein the forefoot mounting region comprises a first recessed region in the forefoot portion of the outsole of the article of footwear and the heel mounting region comprises a second recessed region in the heel portion of the outsole of the article of footwear.

17. The interchangeable footwear kit according to claim 12, wherein each pod of the group of candidate pod sets has a uniformly sized and shaped outer perimeter.

18. The interchangeable footwear kit according to claim 17, wherein the uniformly sized and shaped outer perimeter comprises a V-shape.

19. The interchangeable footwear kit according to claim 17, wherein the outsole defines a first recessed mounting region in the forefoot portion and a second recessed mounting region in the heel portion, and wherein the first and second recessed mounting regions each have an inner perimeter matching the uniformly sized and shaped outer perimeter of the each pod of the group of candidate pod sets.

20. A method for assembling an article of footwear comprising:

selecting a pod set from a group of candidate pod sets, wherein each pod set of the group of candidate pod sets includes a forefoot pod and a heel pod, and wherein each pod set of the group of candidate pod sets has a tread configuration different from other pod sets of the group of candidate pod sets;

placing the forefoot pod and the heel pod of the selected pod set in contact with the outsole of the article of footwear;

selecting a cleat set from a group of candidate cleat sets, wherein each cleat set of the group of candidate cleat sets includes at least two cleats, and wherein each cleat set of the group of candidate cleat sets has a size or material composition different from other cleat sets of the group of candidate cleat sets;

attaching the forefoot pod of the selected pod set to a forefoot portion of the outsole using a first cleat from the selected cleat set; and attaching the heel pod of the selected pod set to a heel portion of the outsole using a second cleat from the selected cleat set, wherein the selected pod set has hemispheric tread elements that are smaller than hemispheric tread elements of other pod sets of the group of candidate pod sets and that are more narrowly spaced than hemispheric tread elements of the other pod sets of the group of candidate pod sets.

21. A method for assembling an article of footwear comprising:

selecting a pod set from a group of candidate pod sets, wherein each pod set of the group of candidate pod sets includes a forefoot pod and a heel pod, and wherein each pod set of the group of candidate pod sets has a tread configuration different from other pod sets of the group of candidate pod sets;

placing the forefoot pod and the heel pod of the selected pod set in contact with the outsole of the article of footwear;

selecting a cleat set from a group of candidate cleat sets, wherein each cleat set of the group of candidate cleat sets includes at least two cleats, and wherein each cleat set of the group of candidate cleat sets has a size or material composition different from other cleat sets of the group of candidate cleat sets;

attaching the forefoot pod of the selected pod set to a forefoot portion of the outsole using a first cleat from the selected cleat set; and attaching the heel pod of the selected pod set to a heel portion of the outsole using a second cleat from the selected cleat set, wherein each cleat of the selected cleat set has a cleat head that is longer than cleat heads of other cleat sets of the group of candidate cleat sets.

22. A method for assembling an article of footwear comprising:

selecting a pod set from a group of candidate pod sets, wherein each pod set of the group of candidate pod sets includes a forefoot pod and a heel pod, and wherein each pod set of the group of candidate pod sets has a tread configuration different from other pod sets of the group of candidate pod sets;

placing the forefoot pod and the heel pod of the selected pod set in contact with the outsole of the article of footwear;

selecting a cleat set from a group of candidate cleat sets, wherein each cleat set of the group of candidate cleat sets includes at least two cleats, and wherein each cleat set of the group of candidate cleat sets has a size or material composition different from other cleat sets of the group of candidate cleat sets;

attaching the forefoot pod of the selected pod set to a forefoot portion of the outsole using a first cleat from the selected cleat set; and attaching the heel pod of the selected pod set to a heel portion of the outsole using a second cleat from the selected cleat set, wherein the selected pod set has hemispheric tread elements that are larger than hemispheric tread elements of other pod sets of the group of candidate pod sets and that are more widely spaced than hemispheric tread elements of the other pod sets of the group of candidate pod sets.

23. A method for assembling an article of footwear comprising:

selecting a pod set from a group of candidate pod sets, wherein each pod set of the group of candidate pod sets includes a forefoot pod and a heel pod, and wherein each pod set of the group of candidate pod sets has a tread configuration different from other pod sets of the group of candidate pod sets;

placing the forefoot pod and the heel pod of the selected pod set in contact with the outsole of the article of footwear;

selecting a cleat set from a group of candidate cleat sets, wherein each cleat set of the group of candidate cleat sets includes at least two cleats, and wherein each cleat set of the group of candidate cleat sets has a size or material composition different from other cleat sets of the group of candidate cleat sets;

attaching the forefoot pod of the selected pod set to a forefoot portion of the outsole using a first cleat from the selected cleat set; and attaching the heel pod of the selected pod set to a heel portion of the outsole using a second cleat from the selected cleat set, wherein each cleat of the selected cleat set has a cleat head that is shorter than cleat heads of other cleat sets of the group of candidate cleat sets.

24. An interchangeable footwear kit, comprising:

an article of footwear having an upper and an outsole;

a group of candidate pod sets, wherein each pod set of the group of candidate pod sets includes a forefoot pod and a heel pod, and wherein each pod set of the group of candidate pod sets has a tread configuration different from other pod sets of the group of candidate pod sets; and a group of candidate cleat sets, wherein each cleat set of the group of candidate cleat sets includes at least a first cleat and a second cleat, and wherein each cleat set of the group of candidate cleat sets has a size or material composition different from other cleat sets of the group of candidate cleat sets, wherein the forefoot pod and the heel pod of each pod set contact the outsole of the article of footwear, wherein the first cleat of the each cleat set attaches the forefoot pod of the each pod set to a forefoot portion of the outsole, and wherein the second cleat of the each cleat set attaches the heel pod of the each pod set to a heel portion of the outsole, wherein each pod set of the group of candidate pod sets has hemispheric tread elements that are at least one of sized differently and spaced differently from hemispheric tread elements of other pod sets of the group of candidate pod sets.

* * * * *